US005390910A

United States Patent [19]

Mandel et al.

[11] Patent Number: 5,390,910

[45] Date of Patent: Feb. 21, 1995

[54] MODULAR MULTIFUNCTIONAL MAILBOX UNIT WITH INTERCHANGEABLE SUB-MODULES

[75] Inventors: Barry P. Mandel, Fairport; Gerald A. Buddendeck, Penfield, both of N.Y.

[73] Assignee: Xerox Corporation, Stamford, Conn.

[21] Appl. No.: 66,825

[22] Filed: May 24, 1993

[51] Int. Cl.[6] ..... B65H 39/10

[52] U.S. Cl. ..... 271/296; 271/9; 271/292; 270/58

[58] Field of Search ..... 270/53, 58; 271/264, 271/272, 287, 289, 291, 292, 296, 297, 298, 301, 302, 303, 314, 184, 294, 9; 198/583

[56] References Cited

U.S. PATENT DOCUMENTS

| | | | |
|---|---|---|---|
| 3,833,911 | 9/1974 | Caldwell et al. . | |
| 3,853,314 | 12/1974 | Anderson | 270/58 X |
| 3,861,673 | 1/1975 | Ticknor . | |
| 3,866,904 | 2/1975 | Stemmle | 271/291 |
| 3,884,458 | 5/1975 | Ryland | 270/58 |
| 3,907,279 | 9/1975 | Ervin . | |
| 3,917,257 | 11/1975 | Caldwell . | |
| 4,285,508 | 8/1981 | Kaneko | 271/291 X |
| 4,359,217 | 11/1982 | Roller et al. . | |
| 4,405,225 | 9/1983 | Perrault | 271/296 X |
| 4,473,857 | 9/1984 | Winter . | |
| 4,501,419 | 2/1985 | Takahashi et al. . | |
| 4,522,485 | 6/1985 | Kamiya et al. . | |
| 4,602,775 | 7/1986 | Calhoun et al. | 270/55 |
| 4,602,776 | 7/1986 | York et al. . | |
| 4,626,156 | 12/1986 | Baughman et al. . | |
| 4,673,176 | 6/1987 | Schenk . | |
| 4,691,914 | 9/1987 | Lawrence | 271/297 |
| 4,711,444 | 12/1987 | Geurts | 271/292 X |
| 4,763,167 | 8/1988 | Watanabe et al. . | |
| 4,763,892 | 8/1988 | Tanaka et al. . | |
| 4,819,021 | 4/1989 | Doery . | |
| 4,830,356 | 5/1989 | Zoltner . | |
| 4,843,434 | 6/1989 | Lawrence et al. . | |
| 4,924,265 | 5/1990 | Partilla et al. . | |
| 4,998,030 | 3/1991 | Cates . | |
| 5,076,556 | 12/1991 | Mandel . | |
| 5,080,340 | 1/1992 | Hacknamer et al. . | |
| 5,090,638 | 2/1992 | Eilenstein-Wiegmanns . | |
| 5,098,074 | 3/1992 | Mandel et al. . | |
| 5,145,168 | 9/1992 | Jonas et al. . | |
| 5,172,162 | 12/1992 | Taneda . | |
| 5,201,517 | 4/1993 | Stemmle . | |
| 5,208,640 | 5/1993 | Horie et al. | 271/298 X |
| 5,246,219 | 9/1993 | Watkiss | 270/58 |

FOREIGN PATENT DOCUMENTS 0241273 10/1987 European Pat. Off. .

OTHER PUBLICATIONS

G. I. Simpson, Jr. "Duplex Copier Incorporating Sorter-Collator", IBM Technical Disclosure Bulletin, vol. 14, No. 5, Oct. 1971, p. 1453.

*Primary Examiner*—Edward K. Look
*Assistant Examiner*—John Ryznic

[57] ABSTRACT

A modular, flexibly adaptable "mailboxing" unit and system for both sequentially processing and separating, into a superposed array of plural separate mailbox print job sheet collection bins or trays, the sheet outputs of various users of various printers (including facsimile receivers, copiers or combination units). The mailbox module has left and right side printer inputs and vertical sheet transport input paths therefrom to at least one vertically modular replaceable sub-module for operating sequentially on sheets in the mailbox module sheet path prior to the separating and feeding of sheets into the mailboxes. The replaceable sub-module comprises at least one of a sheet rotator, a sheet inserter, a sheet inverter, a sheet folder, or a sheet hole punch. The mailbox module then provides a third vertical sheet transport path from the replaceable sub-module past the array of mailboxes to provide a bin selection path for the sub-module processed sheets, with optional compiling and finishing.

5 Claims, 21 Drawing Sheets

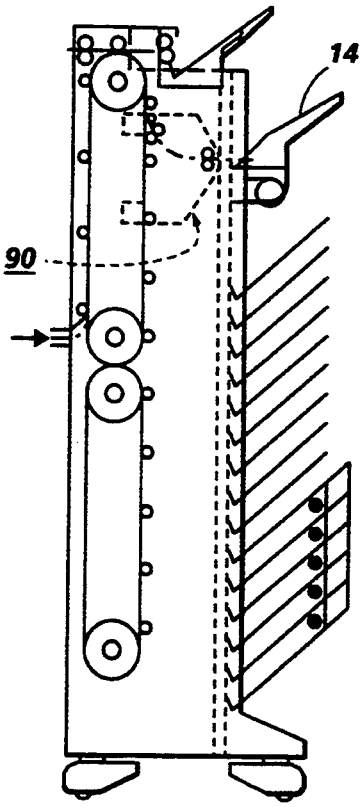
FIG. 4A
FIG. 4B
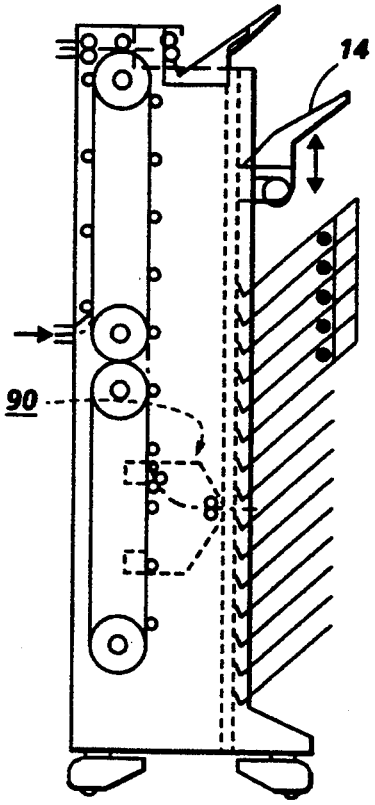
FIG. 4C
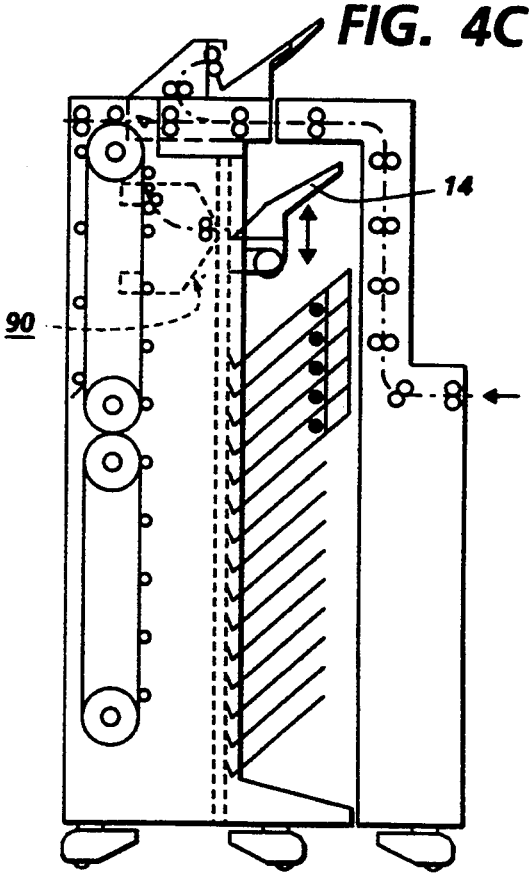

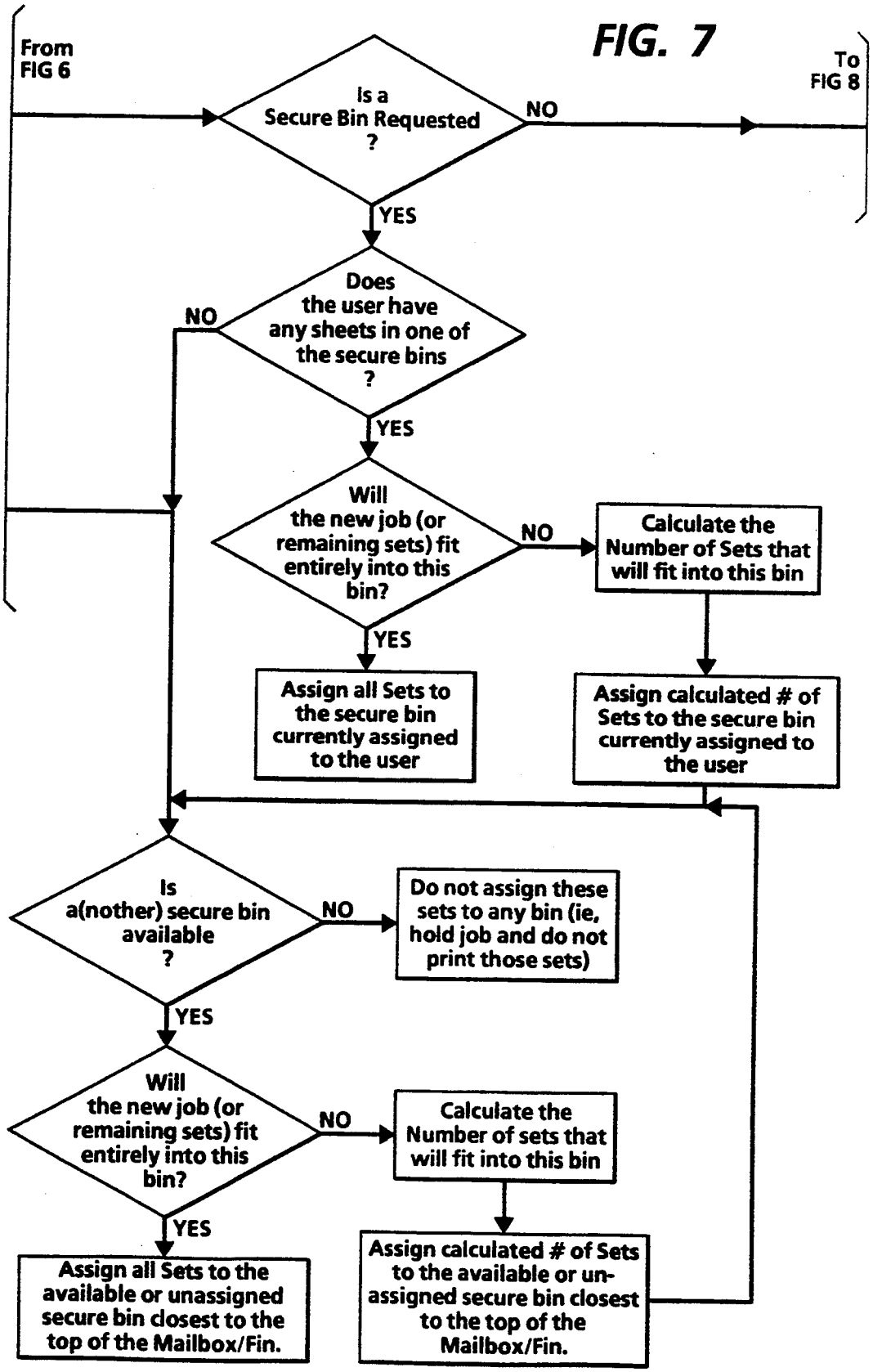
FIG. 7
From FIG 6
To FIG 8
Is a Secure Bin Requested ?
NO
YES
Does the user have any sheets in one of the secure bins ?
NO
YES
Will the new job (or remaining sets) fit entirely into this bin?
NO
YES
Calculate the Number of Sets that will fit into this bin
Assign all Sets to the secure bin currently assigned to the user
Assign calculated # of Sets to the secure bin currently assigned to the user
Is a(nother) secure bin available ?
NO
YES
Do not assign these sets to any bin (ie, hold job and do not print those sets)
Will the new job (or remaining sets) fit entirely into this bin?
NO
YES
Calculate the Number of sets that will fit into this bin
Assign all Sets to the available or unassigned secure bin closest to the top of the Mailbox/Fin.
Assign calculated # of Sets to the available or un-assigned secure bin closest to the top of the Mailbox/Fin.

FIG. 15
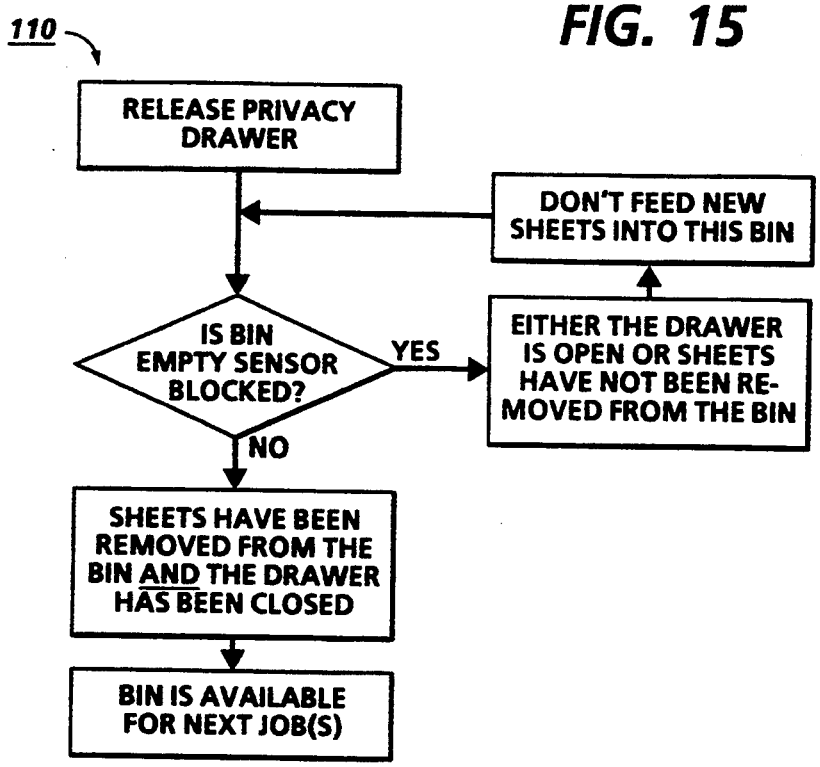
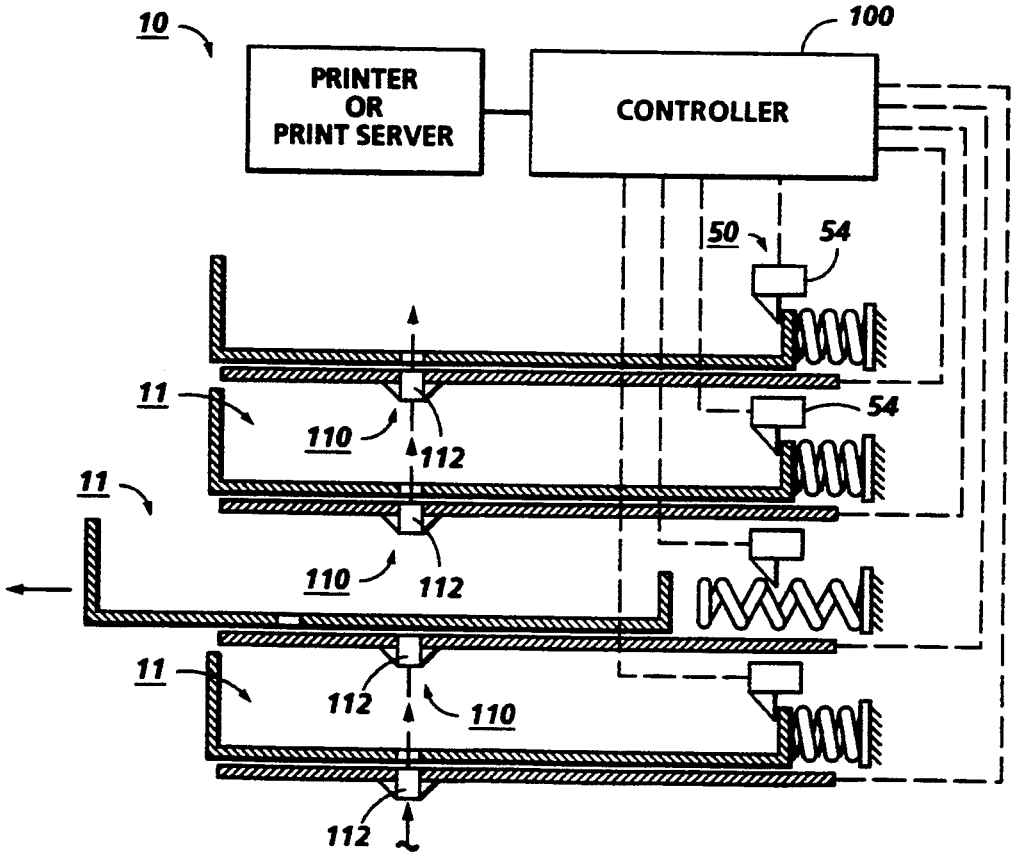
FIG. 16

MODULAR MULTIFUNCTIONAL MAILBOX UNIT WITH INTERCHANGEABLE SUB-MODULES

Reference is made to a copending application by the same assignee, filed concurrently herewith by the same Barry P. Mandel, as U.S. application Ser. No. 08/054,943, now U.S. Pat. No. 5,342,034, issued Aug. 30, 1994, entitled "Mailbox/Compiler Architecture".

Disclosed is a "universal" or variable input and modularly variably featured "mailbox" system for automatically discretely handling and segregating received copier, facsimile or other printer outputs, which can be used as a simple accessory for various existing such printers. In particular, there is disclosed an output sheet sorting system capable of independently handling and separating different jobs for different users or addressees automatically and simply from various printers, with various sheet processing functions in various configurations.

The disclosed "mailboxing" unit embodiment can desirably be a universal modular or stand-alone unit that may be attached to, or even simply moved next to, the output of almost any conventional printer, including facsimile machines or networked electronic mail printers.

Disclosed is a universal (flexible) job sorting or "mailboxing" sheet output system for a printer, copier or facsimile output (encompassed by the term "printer" herein), in which sets or jobs of plural physical sheets outputted by a printer are directed into a particular "mailbox" bin, or set of bins, and the "mailbox" bins of the particular customer or user are indicated for job retrieval. This allows plural users of a printer to have a shared system which automatically puts different users outputs into different "mailboxes" or sorter bins. It can also automatically discretely notify the users of which bins their jobs are in. The disclosed system is "universal" in the sense that the mailbox sorter unit or module is flexible as to where the outputted sheets it receives come from, and can be used with many different printers. Also disclosed in an example herein is an integral job set compiling and finishing (stapling) system.

The disclosed system of the embodiment herein provides "mailbox" units for the output of a system printer with various potential desirable functions, such as sheet rotation, inverting, folding, etc., and then automatically directing [and optionally finishing] print jobs from shared user printers to then-available bins of the "mailbox" unit, which bins will then be variably designated for identification and ultimate display to the users whose jobs have been stacked therein, so that the user will be told which bins of the mailbox unit their job outputs are in. I.e., the mailbox unit and/or the system can then display that job bin location information, preferably restricted to the particular user.

As further discussed hereinbelow, it will be appreciated that in a modern system or networked office environment, various of the control and software functions described herein may be done in the system print server rather than in the mailbox unit or the printer unit per se.

As disclosed in the embodiment herein, another disclosed optional feature can be to provide convenient discrete locked bins security for received hard copies for several different job recipients of shared user printers. That is, also disclosed in the example hereinbelow is electronically controlled bin unlocking for private bins security. These are more accurately described herein as "privacy doors" for certain designated bins. This allows plural recipients to share the same printer or the like receiver, without disclosing, compromising or commingling their separate jobs and/or correspondence. In other words, the disclosed embodiment provides a stand-alone "mailbox" or addressable sorter which can automatically sort and file various conventional output documents (conventional "hard copies", i.e., physical sheets) in discrete designated bins, which can optionally be secured. Yet, as further disclosed, these locked bins can be easily individually unlocked electrically to provide almost instant access to the secured hard copies. With the disclosed system, users or recipients do not need to stand by printers awaiting outputs to avoid their being read, or even accidentally taken, by other users, or commingled together into one stacking tray.

The problem of keeping shared (networked) printer job outputs from becoming mixed up, or accidentally removed by others, especially where commonly stacked, even if the jobs are initially offset, is serious enough that some users have for several years placed manual mailboxes, like Post Office boxes, adjacent the printer, with the boxes labeled with different user names, for manual job sorting. Likewise, for shared facsimile machines.

The following additional partial broad definitions may be helpful to the discussions herein: "Mailbox[ing]": temporarily (or semi-permanently) assigning a unique predetermined electronic address to designated ones of plural bins of a sorter-like output device and enabling a user's output to be directed into a selected bin so assigned. It may or may not include locked bins. Preferably, the user's mailbox output is plural, pre-collated, jobs with all sheets going to a single bin, not requiring sorting. "Sorting": conventionally, this refers to sending one copy sheet of each original page into one bin of a sorter, the next copy sheet into the next bin, etc., repeated for the number of copies, until each of the plural bins required has one copy, then stacking one copy sheet of the next original in each said bin, etc, to compile one collate set in each bin. Thus, job or addressee "mailboxing" is not "sorting" in the common or usual sense of a collating plural identical copy sheets by sequentially placing each sheet in a different bin, and repeating those steps. However, similar "sorter" hardware may be employed in part if it can provide rapid random bin access and other desired features. "Stacking": providing the ability to arrange sets of sheets (which may be stapled or otherwise finished sets of sheets), into a well controlled, generally vertical, common stack, although partial "offsetting" of separate job sets may be desirable.

The term "mailboxing" as used herein refers to handling or sorting physical, i.e., "hard copy" printed sheets. It does not refer to electronic documents or images, which are much easier to manipulate.

To express it in another way, a "mailbox" in the example herein takes multiple print jobs from a printer (from user terminals, fax, networked purge images, scanned document jobs, or the like or combinations thereof) and separates jobs by users and stacks these hardcopy outputted print jobs into individual bins for individual users, by users. [As an additional software option, users may also send print jobs to other users' mailbox bins if desired.] Mailbox bins can, in general, be either user assignable, or automatically assigned by the printer, print server, or mailbox unit. Optionally, jobs can be individually stapled if a stapler unit is provided. Optional security doors can be added to any or all bins if desired. An overflow bin or general, shared, stacking tray may also desirably be provided, not assigned to any one user.

"Mailboxing" may more specifically, as in the example herein, refer to temporarily or permanently assigning a unique and predetermined electronic address to respective ones of plural bins of sorter-like equipment for a copier, printer or facsimile machine output, and enabling a particular user's output of one or more jobs to be directed into one or more selected bins so assigned. It may or may not include means for locking the bins and unlocking access thereto, as indicated above and as in the example herein. It may or may not additionally include a bin assignment scheme wherein each bin has an associated LCD or other type of display with the appropriate user name or label displayed, and/or a common or central display, as in the example herein, and/or wherein jobs are placed in more than one available bin if needed, i.e., if the sheet stacking capacity of one assigned bin is exceeded. As noted, a mailbox for a laser or other electronic page input printer may desirably print and feed plural precollated sets of sheets into a selected bin, rather than functioning as a normal collator or sorter, [although it may do so additionally or alternatively] since an electronic page printer can normally easily electronically reorder and recirculate the "original" pages being copied to "copy" and output them in precollated or serial page job set order, rather than making plural directly sequential copies of each page requiring post-collation and separate bins for each copy set in a sorter or collator.

A specific feature of the specific embodiment(s) disclosed herein is to provide in a mailbox module with sheet transport paths for separately collecting the print job sheets outputted by a shared user printer and selectably separating and feeding said print jobs of respective users into a superposed array of plural separate mailbox print job sheet collection trays, the improvement comprising: said mailbox module having left and right side printer job output sheet inputs; said mailbox module having at least one vertically modular replaceable sub-module; said mailbox module having both a right side generally vertical sheet transport input path, and a left side generally vertical sheet transport input path, for sequentially feeding sheets respectively from said left or right side sheet inputs vertically to said replaceable sub-module; said mailbox module having a third generally vertical sheet transport path from said replaceable sub-module past said array of plural mailbox print job sheet collection trays to provide a tray selection path; said replaceable sub-module comprising at least one interchangeable sheet processing apparatus connecting between said mailbox module sheet transport input paths and said third sheet transport path to form a part of said mailbox module sheet path; and said sheet processing apparatus operating on sheets in said mailbox module sheet path prior to said separating and feeding of print job sheets into said mailbox print job sheet collection trays.

Further specific features disclosed herein, individually or in combination, include those wherein said mailboxing module has a mounting frame on which different said sheet collection trays may be removably mounted at variable spacing positions, and/or wherein a sheet stacking elevator and a selectable plurality and spacing of mailbox bins are both removably mounted to said mailbox module to be selectably fed said printer output sheets by said third vertical sheet transport passing thereby, and/or wherein said left and right side sheet inputs are adapted to operatively engage with the sheet outputs of various shared user printers at different levels on either of two opposing sides of said mailbox module so as to accept different printer sheet output levels, and/or wherein said submodule is vertically mounted on top of said mailbox module and additionally provides a generally horizontal sheet path through said mailbox module for forwarding sheets therethrough on to another said mailbox module, and/or wherein said sheet processing apparatus in said replaceable sub-module comprises at least one of a sheet rotator, a sheet inserter, a sheet inverter, or a sheet hole punch.

The following are further examples of some possible desired and/or optional features, individually or in combinations, for printer "mailbox" output systems, or multi-mode output devices providing that function:

A very desirable mailbox system feature is a "variable bin assignment" system in which many users can share one mailbox unit with only a limited number of bins by variable (dynamic) bin assignments and their electronic logging or tracking, with the bin assignment(s) for a particular user or group of users, depending on bin-availability (the bins empty at any given time) rather then a fixed, permanent assignment of certain bins to certain users or customers. This greatly increases the effective capacity or the number of potential shared users.

Another very desirable and related "mailbox" feature is a "virtual bin" concept, in which the software in a programmed computer or controller controlling the mailbox sheet distributor puts the first job output of user A into an assigned bin X which is determined to be available. Then, if a subsequent job for user A will also fit into bin X, it is also put into bin X. If not, then the subsequent job for user A is automatically put into an assigned "overflow" bin Y, etc. I.e., for each user, the number of assigned bins is automatically increased to meet the users need. Preferably, adjacent bins are used for the job overflow. Art noted re bin overflow features in general includes Xerox Corporation U.S. Pat. No. 3,871,643 issued Mar. 18, 1975 to W. Kukucka and T. Acquaviva; IBM U.S. Pat. No. 4,522,486 to Clark et al. (using the term "virtual bin"); and U.S. Pat. No. 4,134,581 to Johnson, et al. [See further below for the definition of this term herein.]

Another very desirable feature is to use "mailbox" bins to store plural (more than one) bound (e.g. stapled) sets in a selected assigned one or more mailbox bins (i.e. so that any particular user-designated bin can store plural stapled sets from the same or different jobs). [Note in this regard Xerox Corporation U.S. Pat. No. 5,098,074 issued Mar. 24, 1992 to the same Barry P. Mandel, et al (D/88157), especially FIG. 4 and its description and the last paragraphs, and the corresponding abstracted "Xerox Disclosure Journal" publication Vol. 16, No. 5, pp. 281–283 dated September/October 1991.]

Also disclosed of interest in said U.S. Pat. No. 5,098,074 patent, is a partial (shared with a tray) compiler shelf, tamper, stapler, eject rolls, stack height sensor, and other hardware of interest to the embodiment herein. Further noted re partially shared (with a tray) compiler/stackers is Canon U.S. Pat. No. 5,137,265 with a Mar. 6, 1989 Japanese priority.

Another desirable "mailbox" feature is to provide a modular integral unit for improved handling and organizing the sequential sheets output of a wide variety of printers, copiers and/or facsimile machines or combinations or multifunction "combo" units thereof, especially shared user and/or electronically connected interoffice "system" printer units.

Another optional feature is to provide a modular finishing/mailboxing device optionally enabling either left or right printer exit commonality. I.e., the ability to accept sequential sheet output from either right-exit or left-exit printers. Art relative thereto is discussed below.

Another optional feature is to use part of the sheet input transport path or an interconnect module as a sheet inverter or rotator. [Sheet rotators per se are well known, and need not be disclosed in detail herein. See, for example, Xerox Corporation U.S. Pat. No. 5,090,638, issued Feb. 25, 1992 to this same B. P. Mandel, et al., and art cited therein.] It may also optionally use the back side of a sorter-type vertical sheet transport belt to bring documents from the printer into the finisher.

Other options can include providing enhanced job set finishing functions. For example, stapling and/or other binding, punching, folding, special sheet inserts or booklet making, and mailbox sorting of either the finished or unfinished sets.

Another option is to provide a universal output device (mailbox, finisher, high capacity stacker or sorter) which may include simple and/or common bin or tray mounting/removal means for changing the number, spacing, position and type of the bins, and/or so as to permit the device to operate as a high capacity elevator/stacker and/or as a sorter, for a copier or printer, and/or as a multiple bin mailbox or sorter for a copier or printer, or variable combinations thereof. The user can optionally determine the desired number, location and capacity of the bins and/or stacking trays for a particular desired configuration. As noted further below, art noted relative thereto includes U.S. Pat. No. 3,907,279 to Ervin.

Providing for automatic unlocking of selected mailbox bins locked access or "privacy" bin doors for particular users by "keying in" those users' access codes is another desirable option. [See also e.g., pending Xerox Corporation U.S. applications Ser. Nos. 07/933,640 and 07/933,831 by Youti Kuo filed Aug. 24, 1992:D/92247—Automatic Facsimile Output Recipient Telephoning System, and D/91519—Facsimile Output Job Sorting Unit and System; and art cited herein, including U.S. Pat. No. 4,438,101.]

Another desirable feature is a bin assignment display system wherein the mailbox unit has a a central (or bin-associated) LCD or other such bin-identifying operator display, and wherein user's jobs are placed in one, or (if needed) multiple, available bins, with all the appropriate bin(s) identified and displayed for the user name or other identifier, which may also be displayed. [See, e.g., U.S. Pat. Nos. 4,501,419 and 4,437,660, further discussed herein, and D/91519 and D/92247 noted immediately above.]

Optionally, a separate "gathering tray" may be provided for combining job outputs, in the order they were generated, from some or all of the assigned bins, removing the jobs from the bins and outputting them in a single stack. (The effect in this case is that the users will appear to have a single shared bin of variable size.) However, the term "virtual bin" as used herein refers to one aspect of the "dynamic bin assignment" system taught herein, whereby assignment of additional bins for the same user can be automatically provided if the sheet capacity of one bin will be exceeded. This should not be confused with a different use of the term "virtual bin" to refer to systems in which jobs in various bins are automatically unloaded from the bins onto a common separate stack, as in the Xerox Corporation "9900" duplicator "bindexer" set collation, collection and finishing system (as shown in U.S. Pat. Nos. 4,361,393 or 4,411,515; or a U.S. Pat. No. 4,385,827 variant), or set finishing and removal from moving bins, as in U.S. Pat. No. 4,564,185. [Such automatic bin unloading and common stacking (preferably with offsetting) could be added to the system disclosed herein, if desired, but would desirably be limited to removal of all jobs for one user at a time, and only when more than one mailbox bin had been used by that user, so as not to intermix different user's jobs in the common output stack.]

Another option is a system of bin coding and distribution in which a designated user bin code number and the number of pages associated with the user's job are printed and sent on a job cover sheet read by a bin code reader and gated distributor in the mailbox sorter unit, as in the above-cited pending Xerox Corporation applications Ser. Nos. 07/933,640 and 07/933,831, and art cited therein.

Another possible option is a selectable face up or face down inverter/stacker. One example is in Xerox Corporation U.S. Pat. No. 5,201,517 by Denis Stemmle, D/89465, "Orbiting Nip Compiler for Faceup or Facedown Stacking".

The present system is desirably usable for electronic mail hardcopy prints and/or other networked or shared user document prints in general. E.g., in a shared user, networked, printer environment, such as in a modern office environment, the printer can electronically recognize the sender or user terminal sending the printing job from network or document electronic information already available in said job. (Such shared printers may also have alternate scanner or floppy disk document inputs.)

It is additionally noted that combined facsimile and/or digital scanning, copying and printing (and even conventional light lens or digital copying) can be provided in one single unit, encompassed by the term "printer" as used herein. Note, e.g., Xerox Corporation U.S. Pat. No. 4,947,345 filed Jul. 25, 1989 and issued Aug. 7, 1990 to Paradise, et al.; U.S. Pat. No. 3,597,071, filed Aug. 30, 1968 and issued Jul. 27, 1971 to Jones; Fuji Xerox Co. Ltd. U.S. Pat. No. 5,038,218, issued Aug. 6, 1991 to Matsumoto; Sharp U.S. Pat. No. 5,012,892, issued Jun. 4, 1991 to Kita, et al.; and IBM Corp. U.S. Pat. No. 4,623,244, issued Nov. 18, 1986 to D. R. Andrews, et al., originally filed Oct. 4, 1976 (see, e.g., Col. 55). Such plural mode or combination printers are commercially available, e.g., the Xerox Corporation "DocuTech", the Fuji Xerox Co. Ltd. "Able" TM machine series (Able TM 3311, etc.) [Xerox 3010], the Canon "Navigator", and the Okidata "Doc•lt" multifunctional ["combo"] product announced Oct. 28, 1992. The latter allegedly provides simultaneous fax, printer, scanner, and copier capabilities, and includes a controller and image processing board that plugs into a user's PC. Faxes are received on the PC's hard disk. Another such multimode unit is the Xerox Corp. "7033" recently announced as a LAN fax server, scanner, copier, LAN print server, and/or digital printer—all in one network-ready unit. This multifunctional and "turnkey" solution integrates various components within a "NetWare TM"

environment. A server board can be installed in the "7033" machine to allow a direct connection to the network (via Ethernet or token ring), and the machine can be attached directly to the network (like a network-ready printer), without having to dedicate a PC. The fax software provides shared users access to all of the "7033" terminal's features from their workstations. The fax terminal's software package is named "XPCONSOL" and is a menu-driven software which looks and feels like "PCONSOLE" and likewise, may be used to set up the "7033" as a network print server. The "7033" can handle both addressed and unaddressed incoming faxes. Network workstations can fax from the command line, an application, windows, or the copier-scanner itself. Other new multifunctional units include the Ricoh DS5330; and the Cannon GP55 series, also offering optional magneto-optical disk filing.

Note also by way of background that existing Xerox Corporation "ViewPoint" TM shared networked printers already automatically print the particular print job sender's name on a self-generated printed job cover sheet, and also electronically notifies the job sender via the network if there is a printing problem. Such pre-existing printer cover sheet generators also print onto each job cover sheet the number of sheets in that job. For the system herein, such printers may be additionally programmed to add (print) a recognizable unique code pattern to the existing job cover sheet printed for that job (from, e.g., a pre-programmed addressee look-up table), which cover sheet, when fed into this same type of "mailbox" sorter unit (or another), can be read to cause the cover sheet and the other subsequent sheets of that job to be directed into a pre-assigned (preprogrammed) mailbox bin for that user or job originator. Alternatively or additionally, other printer copy sets may be directed in the same manner to other bins with other printed cover sheet code patterns generated from the electronic job directions sent to the printer by the network user.

For further details of the automatic generation of a readable code pattern onto output sheets from a printer, examples are provided in job ticket (job control sheet) printing U.S. Pat. Nos. 4,970,554, 4,757,348, and 4,987,447. The readable code pattern is desirably printed by the regular existing printer image processor which prints the document images on the job sheets output. Alternatively, an on-line extra "annunciator" printer for small areas of the copy sheets in the output path, such as commercially available thermal bar code printers or ink jet printers, may be used.

It will also be appreciated that there are facsimile or other printer system in which the messages or documents are electronically stored rather than printed immediately, in a print server or the like, and in that case, the designated printer or printers and addressees may be changed or forwarded by an intermediate terminal and/or programmed software, which here can be used to change the bin addresses. Furthermore, the job or cover sheet may contain additional encoded information for other copy or distribution controls.

Of particular background interest, job separation "mailboxes" per se, broadly speaking, are known. Unlocked or open bin copier or printer "mailbox" descriptions include U.S. Pat. No. 5,098,074 issued Mar. 24, 1992 to the same B. P. Mandel, et al., by Xerox Corporation [D/88157]. See especially FIG. 4 and its description. In particular, it discloses automatic copier or printer output stacking of plural sets of pre-stapled, precollated, plural sheet copy sets into selected "mailbox" bins, i.e., more than one job set per bin. A printer mailboxing system with locking bins is further noted below—the Xerox Corporation EPO application No. 0 241 273 published Oct. 14, 1987.

In regard to job offsetting, automatically stacking more than one unstapled copy set into sorter bins, with set offsetting, by bin side-shifting for increased bin capacity, is described in the Xerox Disclosure Journal Vol. 14, No. 1, January/February 1989, p. 29, and Sharp patent U.S. Pat. No. 4,688,924. The latter and Minolta U.S. Pat. No. 5,128,762 teach process-direction set offsetting. That is, individual job sets partial offsetting in the rearward or process (input) direction from other otherwise commonly stacked job sets. Copier output tray lateral or side-shifting for plural stacked sets offsetting is also well known, e.g., U.S. Pat. No. 4,157,059. In-bin set tampers, another way of providing single set offsetting, are disclosed, e.g., in U.S. Pat. Nos. 5,188,353; 5,044,625 [D/87242]; 3,860,127; 4,134,672; 4,477,218; 4,480,825, 4,616,821; and 4,925,172, and art cited therein.

The alleged utility of otherwise conventional existing sorters for [unlocked] printer output sorters or "mailboxes", and printer "mailboxing" in general, is briefly discussed in Col. 1 of U.S. Pat. No. 4,843,434 issued Jun. 27, 1989 to F. Lawrence, et al, by Gradco Systems Inc. (see below); and U.S. Pat. No. 4,763,892 issued Aug. 16, 1988 to H. Tanaka, et al.

The above-cited Canon Takahashi et al. U.S. Pat. No. 4,051,419, issued Feb. 26, 1985 and filed Aug. 20, 1981, is of particular interest for its random bin access and an early teaching of collating paper output of either a laser printer or a copier with automatic bin input switching from detected full bins to bins from which the papers have been removed, for maximizing bins utilization and minimizing printing delays. The operation described is that for sorting (collating) not mailboxing of collated job sets. However, the bin and sheet path sensors described there (and elsewhere) may be used herewith, if desired. As noted, this same reference also teaches bin indicator displays.

U.S. Pat. No. 4,691,914 issued Sep. 8, 1987 to F. J. Lawrence (Gradco Systems, Inc.) discloses a random plural bin access [with plural solenoids] sheet receiver. It discloses sheet input from both the right or left sides, indicated as from a copier and a printer respectively.

U.S. Pat. No. 4,830,358 filed Sep. 9, 1987 and issued May 16, 1989 to D. Fazio, et al. [Gradco Acquisition Corp.] refers to "mailbox" sorters merely in citing a prior U.S. Pat. No. 4,288,070 to Fred R. Lagner [which does not itself discuss that] in Col. 1, lines 29–31. Said U.S. Pat. No. 4,830,358 also says in Col. 1 line 44 that it provides a sorter in which the trays may be "randomly accessed", and discusses that further re a printer connection in at least Col. 11. Col. 8 bottom to Col. 9 top, et al. This U.S. Pat. No. 4,830,358 patent further discloses printer/sorter command signals and controls.

The above-cited Gradco Systems, Inc. U.S. Pat. No. 4,843,434 filed Nov. 17, 1987 and issued Jun. 27, 1989 to F. Lawrence et al. has a brief discussion of "mailboxing" for electronic or laser printers in Col. 1, lines 28 et al., noting in particular there that: "mailboxing is more difficult, because the documents or jobs destined for different mailboxes may not and most likely will not be processed in sequence. Thus, mailboxing requires random access or positioning of the sheet feed for delivery to a selected bin or mailbox." [Col. 1 lines 37–42]. This specification then goes on to indicate that rapid bin movement is a problem for that in the prior art sorters, and that it provides high speed job separation and ease of random access operation.

Of further "mailbox" interest, in Seiko Epson Corporation U.S. Pat. No. 5,141,222 issued Aug. 25, 1992 by Shigeru Sawada, et al., (and its equivalent EPO Application No. 0 399 565 "Printer" published Nov. 28, 1990), a modular unit sorter is generally indicated in Col. 1 to be for sharing a printer with a plurality of users, sorting and compiling copies by user. It claims an output sorter having fixed trays and a pivotable sorter guide member for directing copy sheets to a sorter tray. Each tray may also have a gate mechanism for retaining sheets in the tray. It is suggested in Col. 6 that a mailbox can be assigned or dedicated to each user, and used as a "mailbox" by entering an ID code and printing data. This reference is also of interest re detecting the fullness of a sorter bin and for delivering copy sheets to the next available sorter bin. I.e., also disclosed in said U.S. Pat. No. 5,141,222 reference Col. 8 are means for detecting the fullness [reaching of sheet stacking capacity] of a tray and incrementing this sorter tray copy sheet guide to another (empty) sorter tray. As noted, another example of that is disclosed in that above-cited Canon U.S. Pat. No. 4,501,419, issued Feb. 26, 1985 to Y. Takahashi, et al. (also cited herein re its bin entry gating and its bin display features).

Note, however, that especially with stapled sets, as disclosed herein, where whole job sets may be put into a bin at a time (vs. sheets stacked in the bin one-at-a-time), the decision to put the next job in another bin should be made in advance, with knowledge of the size of the next job set versus the remaining capacity of the bin presently being used for job stacking.

Printer products noted with integral open sorter bins [the bin selection system is not known] include the Canon NP-9030 sold for several years with a sorter option; the Kyocera F-2010 and F-3010 laser printers with their 5 bin sorter option (since 1988?); and Océ van der Grinten Corporation's recently commercially displayed "6750" and "6800" printers configurable with either 20 or 40 bin optional programmable sorter/mailboxes. Toshiba and its OEM Genicon recently announced a 10 bin "mailbox sorter" for their network printers, supported by a Windows driver. The Toshiba user selects a bin number from the driver menu (not the network). Thus, users all have to agree among themselves who gets what bins. The Genicon system allows the network administrator to assign bins.

"Mailboxing" by bar-coded user-identifying removable tape which is taping together output job sets of a printer output is specifically mentioned in the paragraph bridging pages 25–26 of copending D/90136 and D/91042, by Murray O. Meetze, with the same assignee, filed Dec. 16, 1991, as U.S. Ser. Nos. 07/808,241 and 07/808,133.

As noted, a desirable additional feature for mailboxing systems is to staple or otherwise bind, fasten or finish the sheets of each job together, so that plural finished sets are removable as such from the user's bin(s), maintained neatly stacked and separated from other jobs by being fastened. This can be done by precompiling and stapling sets before they are placed into mailbox bins, as in the above-cited U.S. Pat. No. 5,098,074 to the same B. Mandel, et al.

Alternatively, job set stapling could be done by using in-bin stapling, which is well know for sorters, e.g., Xerox Corporation U.S. Pat. No. 3,884,408 to L. Leiter et al.; U.S. Pat. No. 3,944,207 to Bains; U.S. Pat. No. 3,995,748 to Looney; U.S. Pat. No. 4,687,191 to Stemmle; U.S. Pat. No. 4,681,310 to Cooper; and U.S. Pat. No. 4,925,171 to Kramer, et al. Also, Xerox Corporation R/84007 U.K. 2 173 483-A GB published 15 Oct. 1986 by Denis Stemmle; and R/81011 U.S. Pat. No. 4,687,191 issued Aug. 18, 1987 and published in the EPO as 0198970-A1 on 29 Oct. 1986. Also, U.S. Pat. No. 4,083,550 issued Apr. 11, 1978 to R. Pal. Other Xerox Corporation patents include Snellman et al U.S. Pat. No. 4,145,241 and Hamlin et al U.S. Pat. No. 4,564,185 on edge jogging and glue binding sets in a sorter or collator and/or stapling of the post-collated copy sets. Withdrawal of the sets from the respective bins with a gripper extractor and for on-line stapling as in the Xerox Corporation "9900" copier is shown for example in Xerox Corporation U.S. Pat. No. 4,589,804 to Braun et al.; U.S. Pat. No. 4,361,393 to Noto and U.S. Pat. No. 5,024,430 issued Jun. 18, 1991 to Nobuyoshi Seki et al. (Ricoh) which also returns stapled sets to the bin, and has a stapler movable along the array of bins. Recent Japanese owned patents in this area include U.S. Pat. No. 4,762,312 issued Aug. 9, 1988 to Y. Ushirogatn (Ricoh); Minolta U.S. Pat. No. 4,801,133 issued Jan. 31, 1989 based on 7 Japanese applications filed Nov. 27, 1986; and several Canon patents and EPO patent application publications on in-bin stapling systems such as EP 301-594, 5, and 6-A with Japanese priority app. number 191934 filed 30 Jul. 1987. Also, U.S. Pat. No. 5,125,634 issued Jun. 30, 1992 to Frederick J. Lawrence (Gradco); U.S. Pat. No. 5,131,642 issued Jul. 21, 1992 to Hiroshi Yamamoto (Ikegami Tsushinki) and U.S. Pat. No. 5,150,889 issued Sep. 29, 1992 to Taguchi (Mita).

As may be seen from the above, integral sorter/stapler units with in-bin stapling are well known. Typically, as disclosed, the stapler unit moves or pivots partially into each bin and staples each set therein, or the compiled set is moved slightly out of the bin, stapled and moved back into the bin, or the bin moves or pivots into the stapler unit. However, it is difficult to do so for more than one stapled set per bin. That makes in-bin stapling difficult to use for plural jobs "mailboxing". The system disclosed in the example below does not have that problem.

By way of further background, one cannot staple output job sets until after they are collated. Thus, for post-collated copier output, a sorter must fill all the required bins with all the copies of the job before stapling any of them. On the other hand, precollation copying, by using an RDH, or an electronic printer, with "mailboxes", allows the job sets to be printed out as pre-collated job sets and delivered as such to an individual bin and finished one set at a time.

As noted, another desirable "mailboxing" feature is secured bins. Prior art on lockable and unlockable copier or printer bins or mail boxes for the output sheets thereof includes the above-cited EPO application No. 0 241 273 by Xerox Corporation published Oct. 14, 1987, [D/86031 EP], entitled "Limited Access Reproducing Machine Bins", disclosing a reproducing machine with lockable and unlockable bins which can be selected by the user for receiving copy sheets, precollated or uncollated. It teaches alternatively remote user or laser printer input, with copy bin lock boxes, and central computer display bin electrical bin unlocking entry and control usable herewith. Further as to bin locking, U.S. Pat. No. 4,470,356 entitled "Word Processor-Controlled Printer Output Bin Lock Box", issued Sep. 11, 1984, to Datapoint Corp., by D. Davis, et al., discloses a lockbox insertable and removable from an output bin. A security door is closed to allow removal of the box. U.S. Pat. No. 4,437,660 entitled "Word Processor—Controlled Printer Output Scanner Mechanism", also issued Mar. 20, 1984 to Datapoint Corp., is if particular interest as disclosing a scanning mechanism for scanning individualized output bins collecting laser printer output for determining each bins availability, the degree of fullness, and whether or not a lockbox is positioned in the bin. U.S. Defensive Publication No. T102,102 entitled "Access Controlled Copier" Published Aug. 3, 1982 by Albert Bolle, et. al., discloses sorter bins which can be locked to the user by means of a badge reader or the like. The user-entered identification data is entered and recorded on the first copy which is delivered to the locked sorter bin or bins. IBM Corp. U.S. Pat. No. 4,414,579 entitled "Information Transmitting and Receiving Station Utilizing a Copier-Printer" issued Nov. 8, 1983 discloses a secured mailbox located at the bottom of the collator. Xerox Corporation reportedly provided modified copier sorters with locked bins for at least the U.S. State Department many years ago.

Among examples of keyboard or keypad enterable electronic security systems in general are U.S. Pat. Nos. 4,970,504; 5,014,049; and 5,021,776.

Additionally noted is the Ricoh FAX4000L facsimile machine, which describes in its literature the following feature called "Confidential Transmission": "If the other end has memory and the confidential reception feature, you can use confidential transmission. The other end can only print the message after they enter the terminal programmed password. For extra security, you can specify the password for the message. This personal password will override the password that the other terminal user has previously stored in their machine, which would normally be used for printing confidential messages. Coordinate with the receiver operator before using this feature. This feature works if the receiver is using a recent Ricoh [only?] memory facsimile terminal."

On another optional or desirable feature, art relating to sorter bin assignment schemes wherein the bins have an associated LCD or the like type of visual display includes U.S. Pat. No. 3,905,594 to Davis; and the above-noted U.S. Pat. No. 4,437,660 to Tomkins et al; U.S. Pat. No. 4,501,419 to Takahashi, et al.; and U.S. Defensive Publication T102,102 to Bolle et al. Also, Fuji Xerox Corp. FX-10475 Japanese Application No. S 59-55424, filed Apr. 17, 1984 and published on Nov. 6, 1985 as Kokai No. 60-167054.

On another optional or desirable feature, the control and operation of multi-bin sheet collators or sorters to use or group more than one adjacent bin when the number of sheets in a copy set will exceed the capacity of a single bin is known, for example, from U.S. Pat. No. 4,522,485, the above-cited Takahashi et al. U.S. Pat. No. 4,501,419, or U.S. Pat. No. 4,134,581, and various above and other references.

Said Takahashi et al. U.S. Pat. No. 4,501,419 is also of interest as showing individual pivotal bin gates, which gates also have another surface normally providing a "ski" or baffle for holding sheets against the sorter transport belt as they move past the array of bins until they reach the selected bin (see especially FIG. 3 thereof).

There were also commercially available for many years sorters in which bins were sequentially or randomly programmably addressable by punched card, paper tape or keyboard controls, and/or a programmable minicomputer with displays and memory for tray address and sheet count information, as noted in U.S. Pat. No. 3,905,594 to E. D. Davis (Norfin, Inc.) issued Sep. 16, 1975. The latter also suggests printing and feeding binary address printed cover sheets in Col. 3, top, and Col. 8, middle.

When a sorter unit is to be alternatively used for, or converted to use for, a printer mailbox unit, it may be desirable to increase the available sheet stacking space between bin trays or shelves to increase bin capacity. Moving or removing sorter bin shelves for doubling or tripling the number of multiple copies which a particular bin can receive is taught for a sorter per se in U.S. Pat. No. 3,907,279 issued Sep. 23, 1975 to J. H. Erwin by AM Corp. See especially Col. 3. Doing so for different numbers of copies or documents to different users in preprogrammed bin sequences is suggested in Col. 1.

A sorter or collator modular unit description which indicates that it can accept copy sheets inputted from either of two opposite sides thereof from a copier or printer, with or without inversion for face up or face down output, and other typical sorter options or modes, such as noncollated top bin only stacking or progressive bins sort stacking of identical copies, is in U.S. Pat. No. 3,638,937 issued Feb. 1, 1972 to L. J. Schulz, et al. [3M]. However, it appears from the further description in Col. 8 thereof that the one said side entrance 14 will always invert the input, and the other side 13 entrance will always not invert the input, so that this unit would not actually be interchangeably usable with all left or right end outputs. Mita U.S. Pat. No. 5,056,768 is noted re selectable right or left hand printer output. Xerox Corporation U.S. Pat. No. 3,866,904 issued Feb. 18, 1975 to D. J. Stemmle shows inserting sheets into a set of sorter bins from either side thereof for simplex or duplex copies, i.e., with or without inversion, but all copies enter that unit from one side of the sorter module. Note, however, the above-noted Gradco U.S. Pat. No. 4,691,914 with sheet input from both the right and left sides, indicated as from a copier and printer, respectively.

As to usable specific or alternative hardware components of the subject apparatus, it will be appreciated that, as is normally the case, some such specific hardware components are known per se in other apparatus or applications. For example, various commercially available stand-alone, self-controlled modular sorter units are known for sorting the output of xerographic copiers or printers, with various hardware systems. Examples include above-cited art and its references.

If sheet input side registration is desired, examples of sheet feeding side registration systems and hardware include Xerox Corporation U.S. Pat. Nos. 4,487,407; 4,411,418; 4,621,801; 4,744,555; 4,809,968; 4,919,318, and 5,065,998.

In the description herein the term "sheet" or "hard copy" refers to a usually flimsy sheet of paper, plastic, or other such conventional individual physical image substrate, and not to electronic images. Related, e.g., page order, plural sheets, documents or copies can be referred to as a "set" or "job". A "job" may also refer to one or more documents or sets of documents beings sent to or received by a particular addressee or designee. The term "copy sheet" or "output" or "output sheets" herein is still generally used to refer to the paper or other such typical flimsy physical image substrate sheets outputted by a reproduction apparatus, such as a xerographic copier or printer, and whether imaged or printed on one or both sides. These output sheets are now often, of course, not literal "copies" in the old-fashioned sense, since the term now may also encompass computer-generated graphic images (as well as various text) for which there is not necessarily a physical "original" being copied optically or electronically scanned, although that is also encompassed by the term "copy" or "output" sheets here. The term "document", unfortunately, unless defined, is used ambiguously in the art by others to refer to either a single page or multi-page set or job, especially (but not always) as that which being transmitted or copied. "Original" is more specifically used for the latter. "Facsimile", or the common abbreviation "Fax", often refers to conventionally telecommunicated image data, in particular, documents facsimiled via a telephone system in accordance with CCITT Standards, and equipment therefor. However, for claim purposes herein, "facsimile" can also encompass "electronic mail" and/or system or network interconnected printers, networked with remote terminals and/or scanners, and remote printers, or the like, unless indicated otherwise. Plural mode (multi-function) combined normal printing and facsimile message receiver printing capability printers are known, and examples thereof are cited in this specification. Facsimile can be sent and received by "fax cards" in PC's (personal computers or terminals) as well as with conventional standalone facsimile machines. The term "printer" encompasses various means for hard copy output from various input sources, including facsimile, although it often conventionally refers to electronic document images input, versus a light-lens copier to which physical originals must be brought to be directly fed and imaged. The term "electronic mail" also has various broad meanings, and can include transmission by either external telephone lines, and/or shared internal networks using optical fiber, twisted wire pairs, coaxial cable, wireless transmissions, or other networking media, or combinations thereof, of documents for electronic remote terminal displays and/or printer hardcopy printouts, to any of the numerous addresses designated in the transmitted document.

The presently disclosed apparatus may be readily operated and controlled in a conventional manner with conventional control systems. It is well known in general and preferable to program and execute such control functions and logic with conventional software instructions for conventional microprocessors. This is taught by various patents such as U.S. Pat. No. 4,475,156 and art cited therein, and various commercial facsimile machines, copiers and sorters. Such software may of course vary considerably depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of embodiments thereof, including the drawing figures (approximately to scale) wherein:

FIG. 1 is an partial frontal schematic view of one embodiment of the subject "mailboxing" system unit, with an exemplary display panel and keypad, shown operatively connecting with and receiving the output of copy sheets of a conventional shared user printer, shown schematically. This mailbox unit is shown here with an interface module at the right hand side for transporting output from the left end or side of the printer apparatus [right side printer output may alternatively be received directly at the left side of the mailbox unit, as shown in other Figures];

Figure 1:
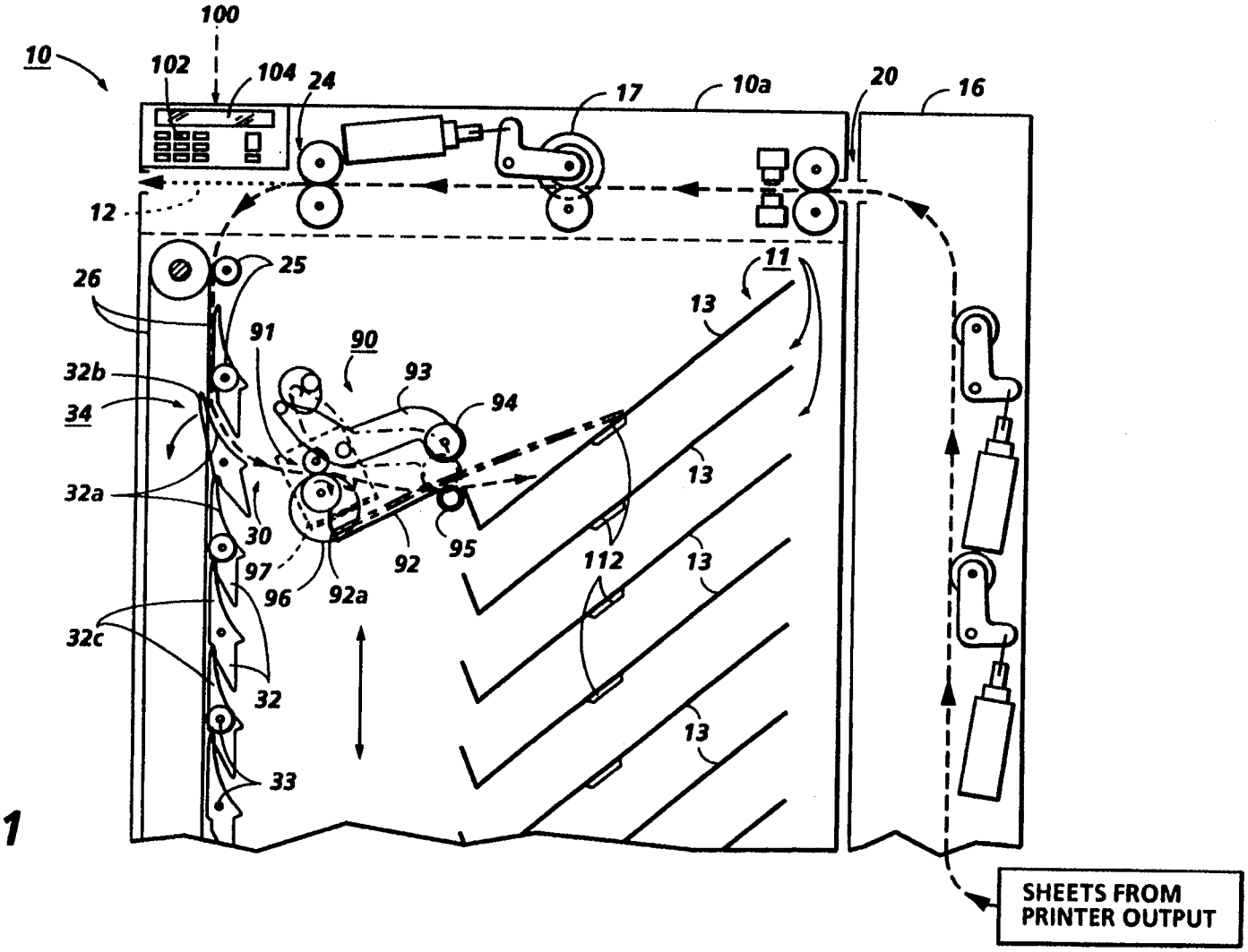
Figure 2:
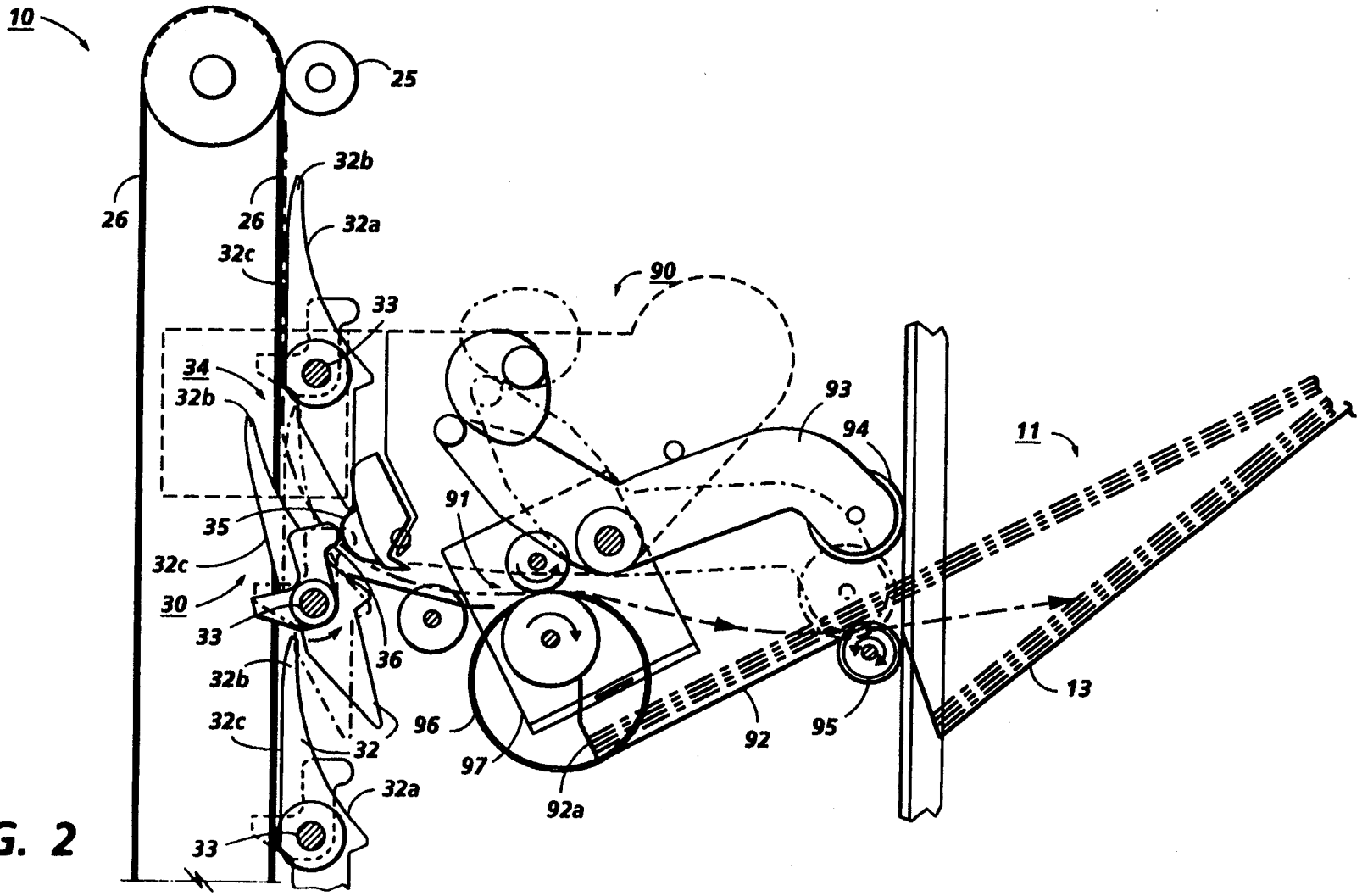
FIG. 2 is in an enlarged partial frontal schematic view of the exemplary moving sheet selector, compiler, stapler and job set ejector unit integral the mailbox unit of FIG. 1.
Figure 3:
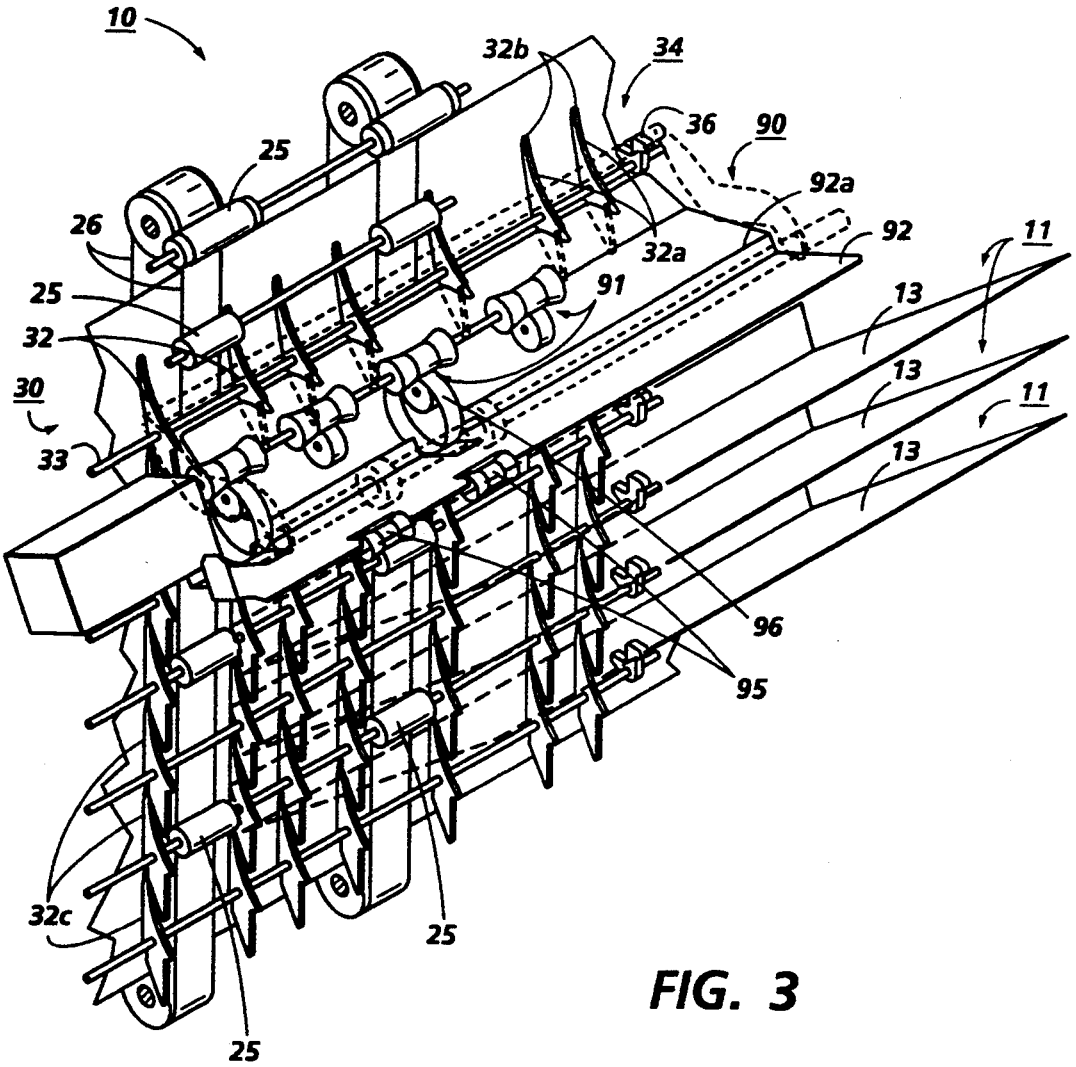
FIG. 3 is a more detailed partial internal perspective view of an exemplary sheet distribution (bin selection) system which may be used in the exemplary mailboxing system of FIG. 1 and other Figures, also showing part of said exemplary moving compiler et al. unit associated therewith.
Figure 5:
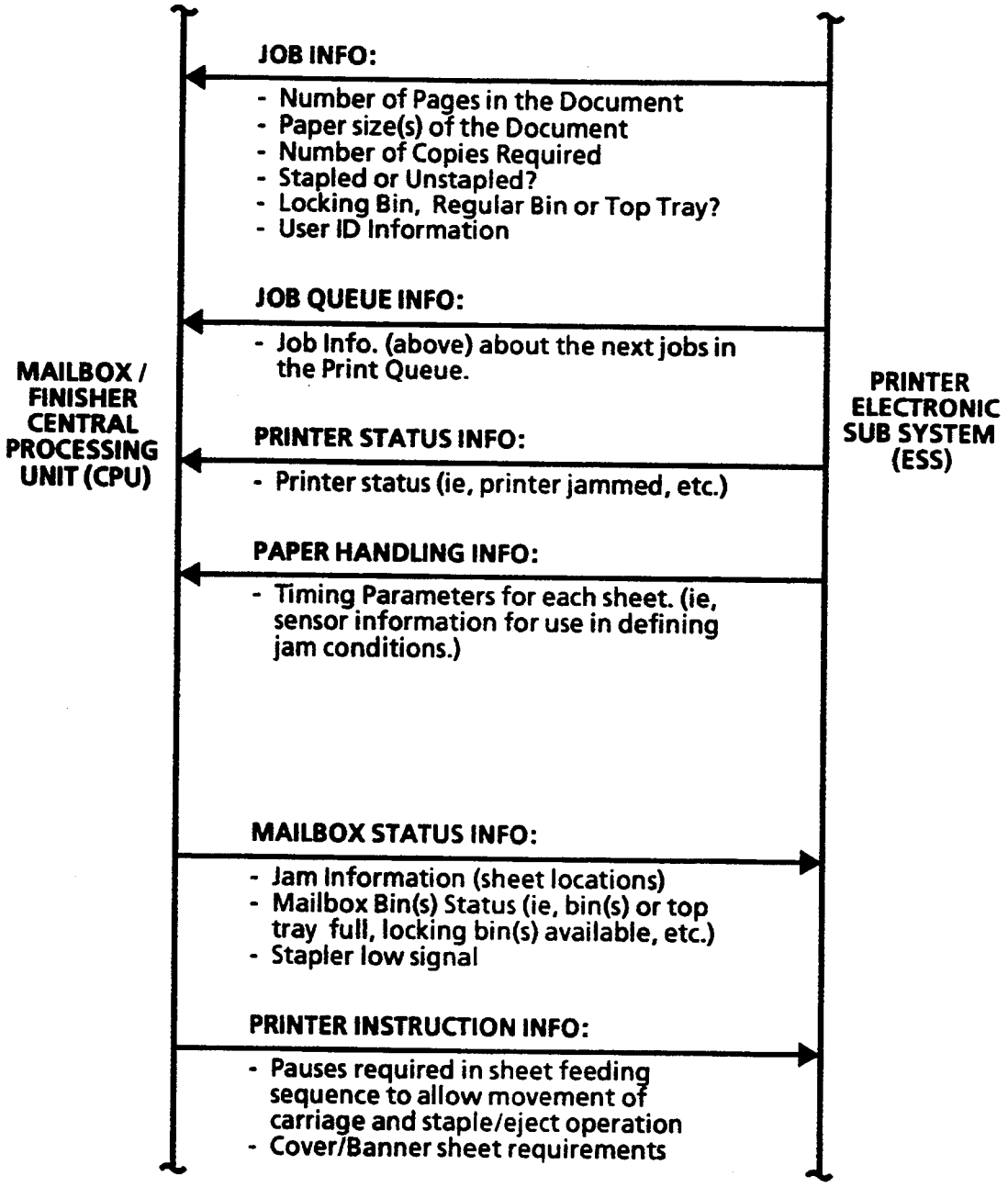
Figure 6:
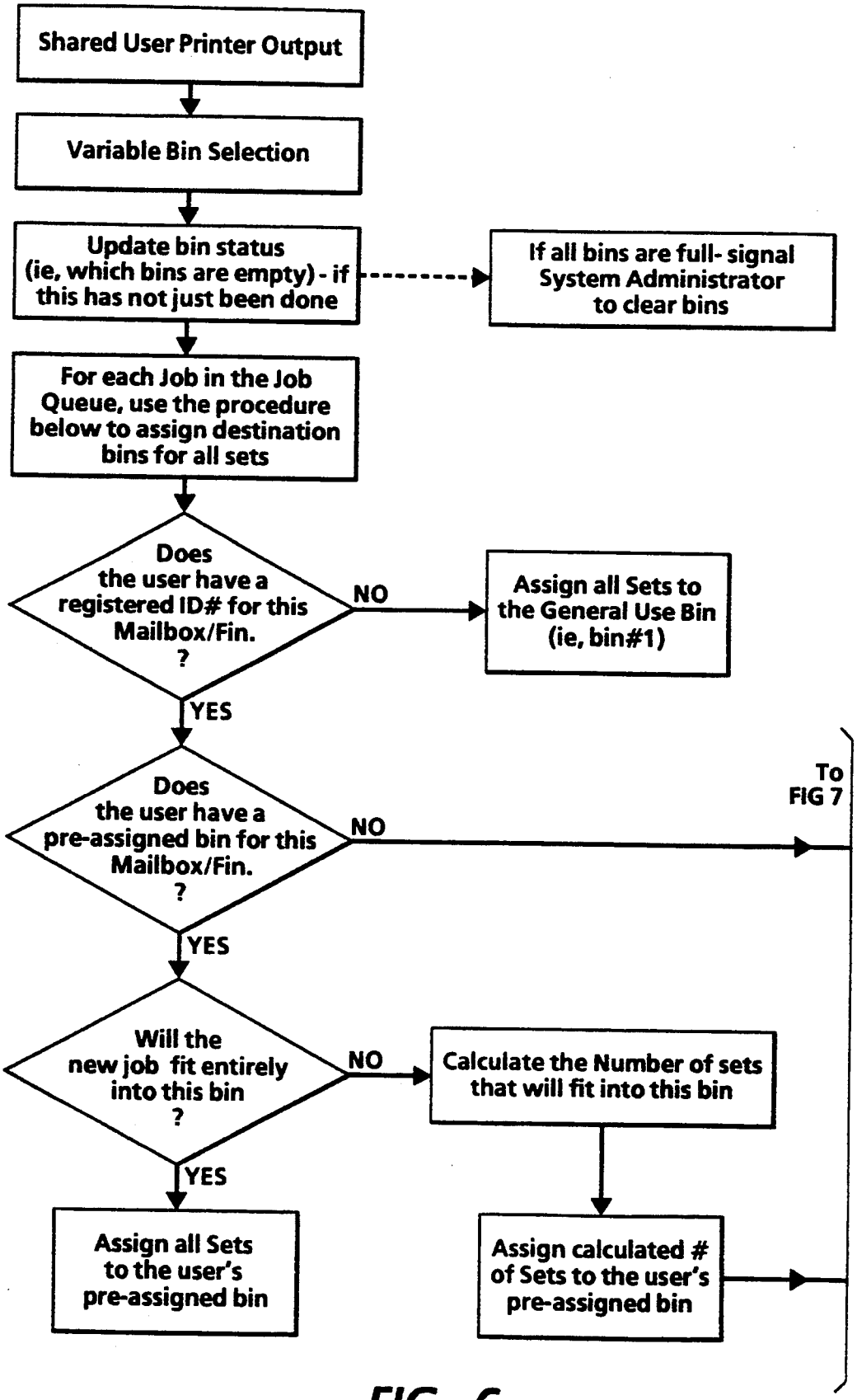
Figure 8:
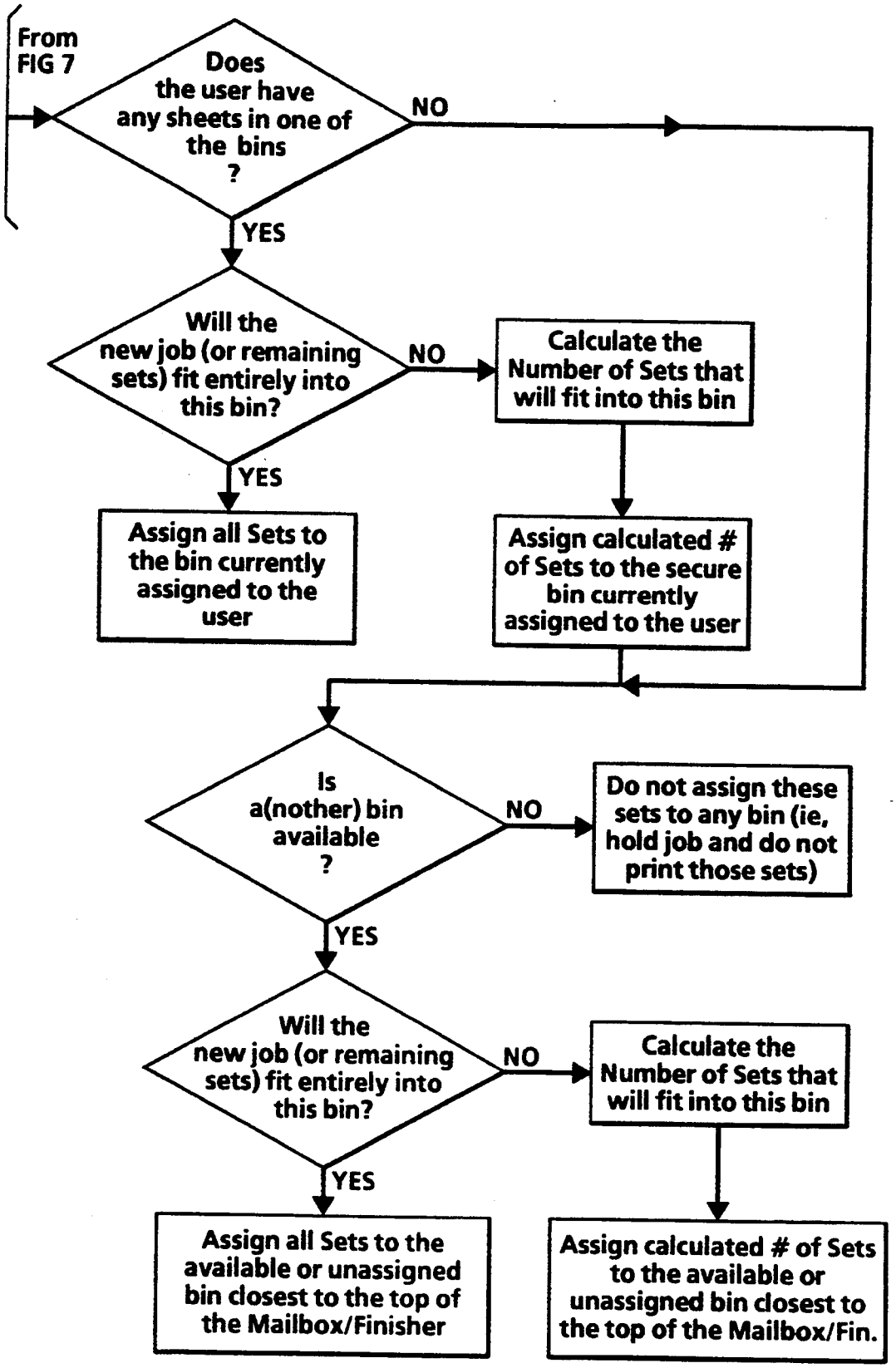
Figure 9A:
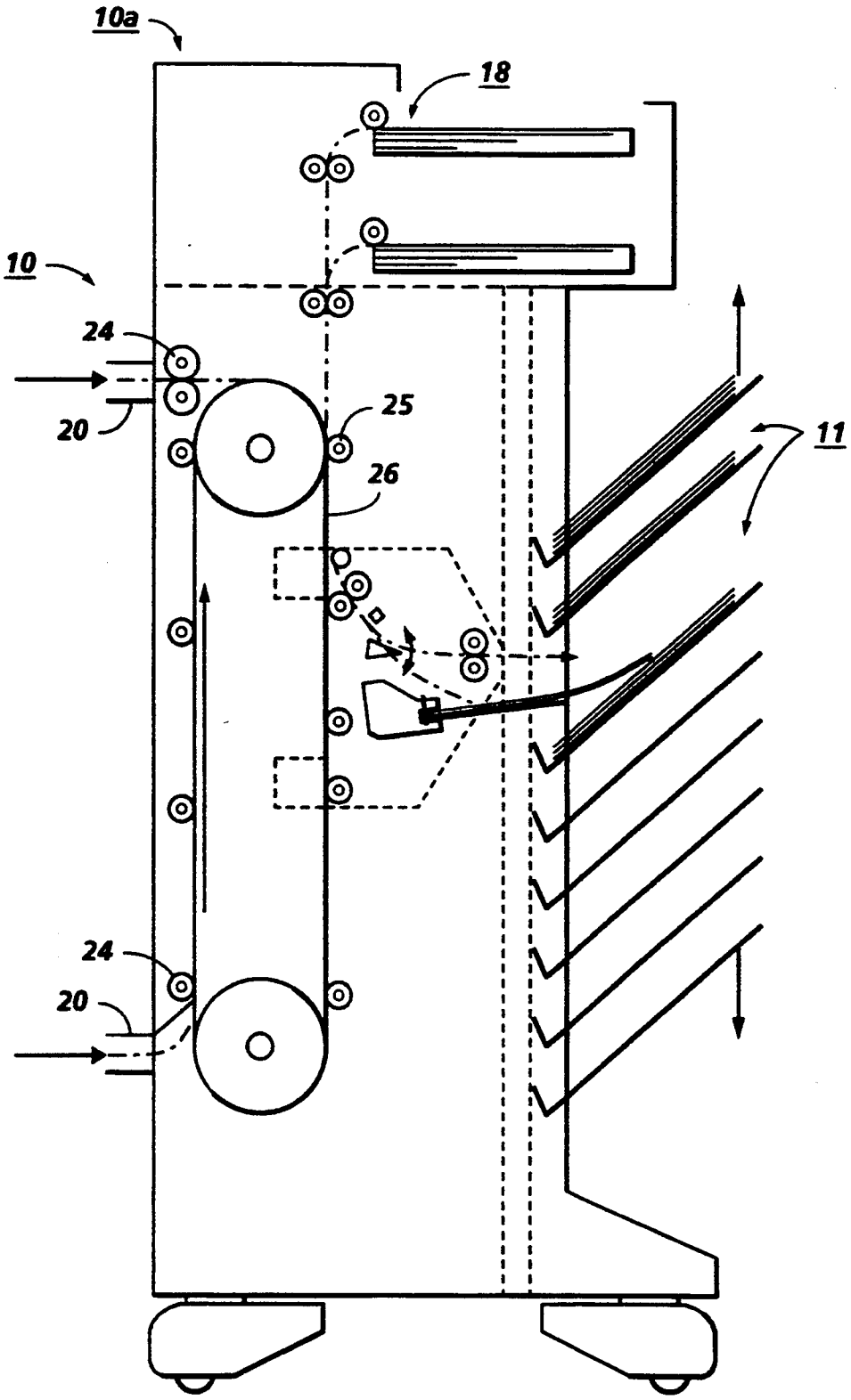
Figure 9B:
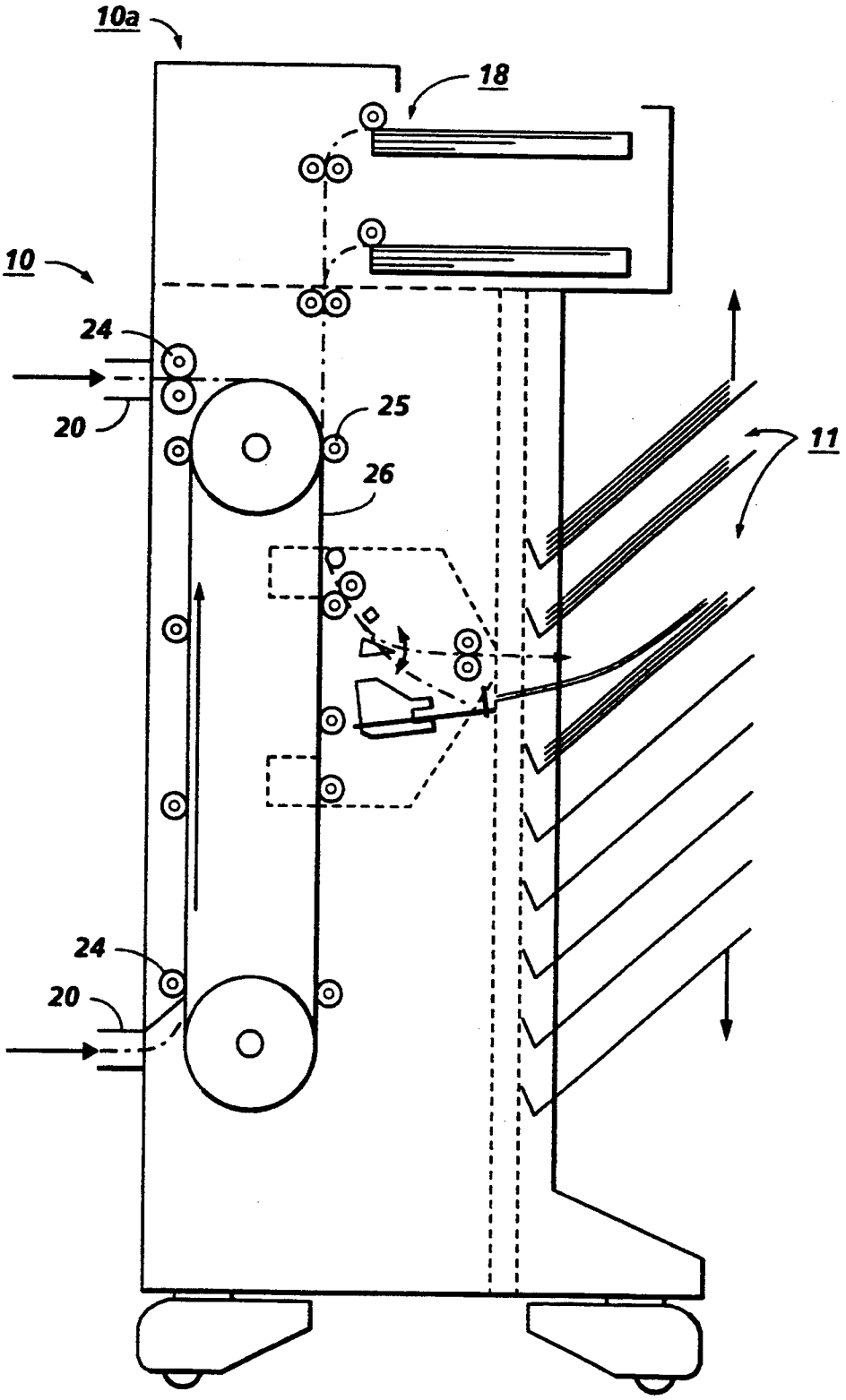
Figure 10:
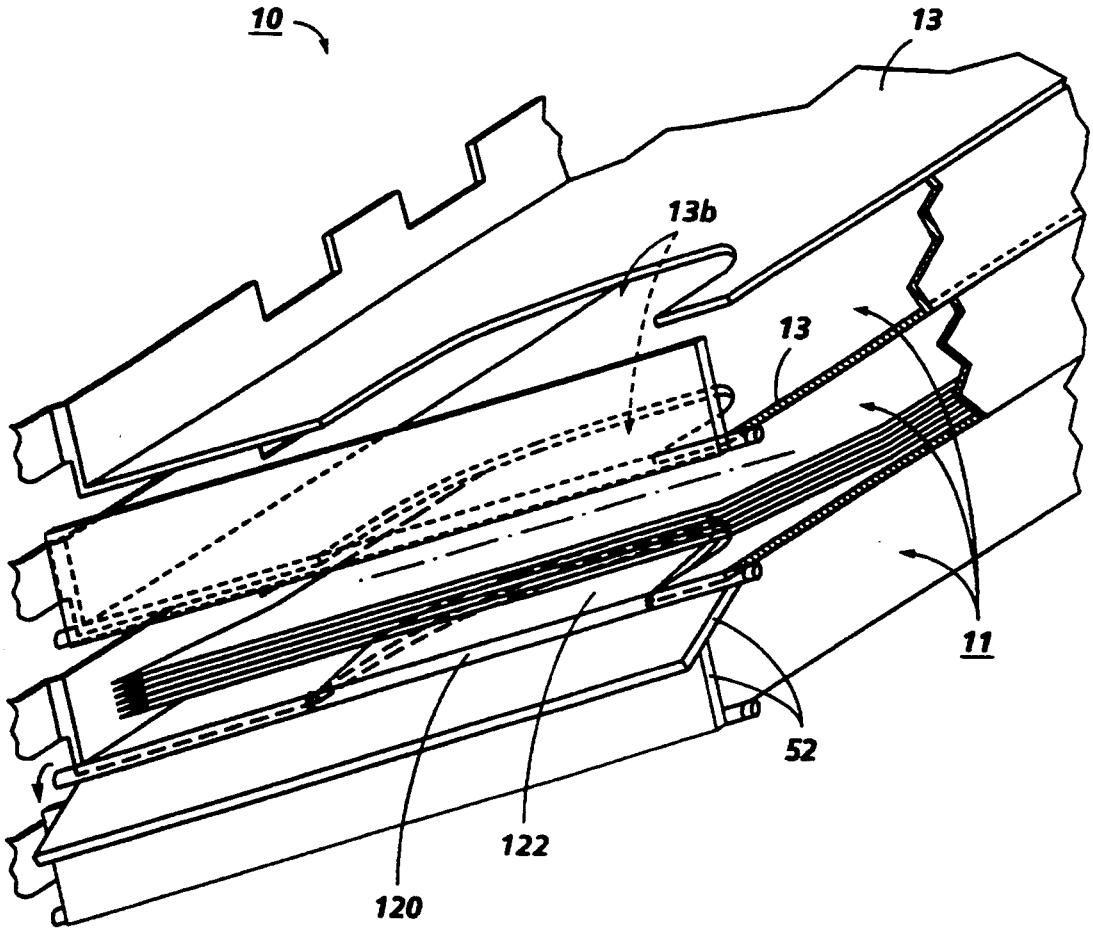
Figure 11A:
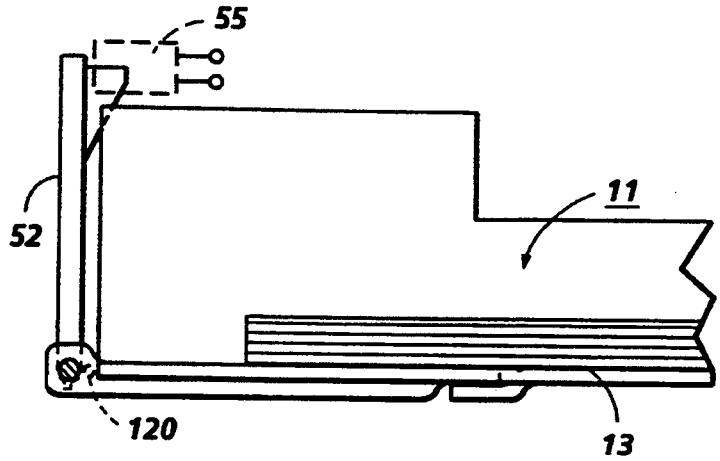
Figure 11B:
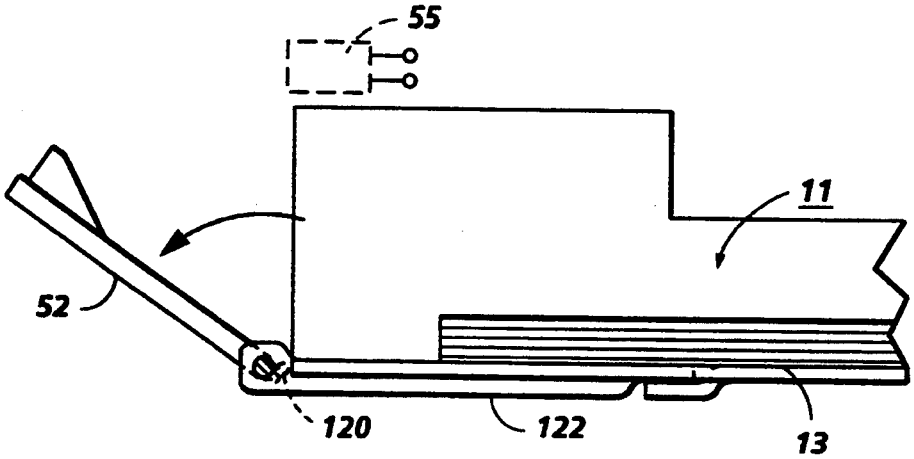
Figure 11C:
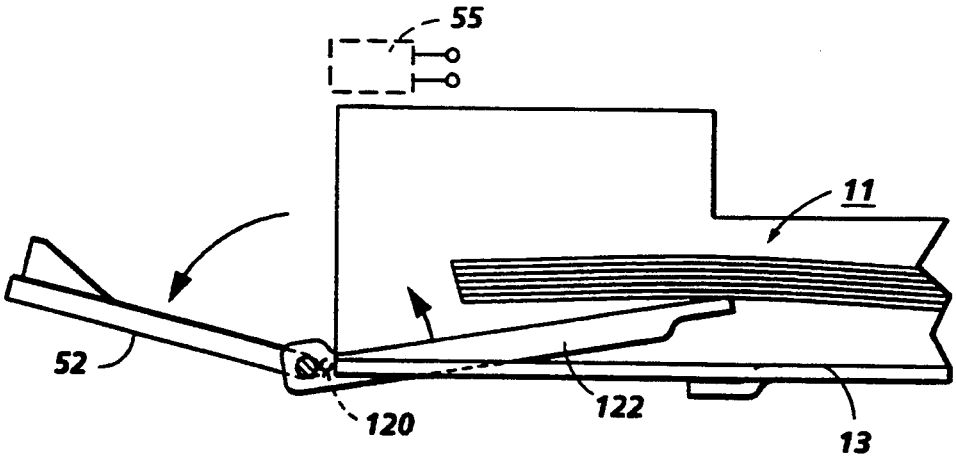
Figure 12A:
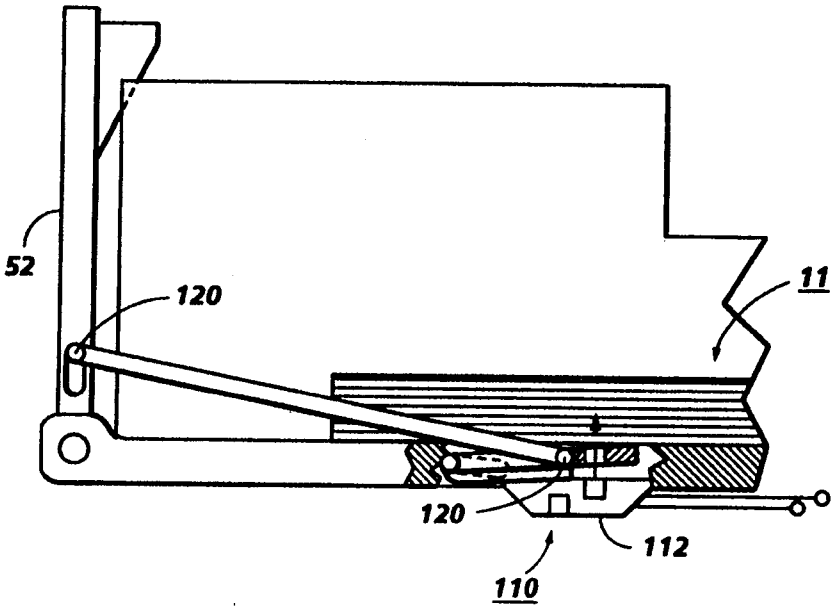
Figure 12B:
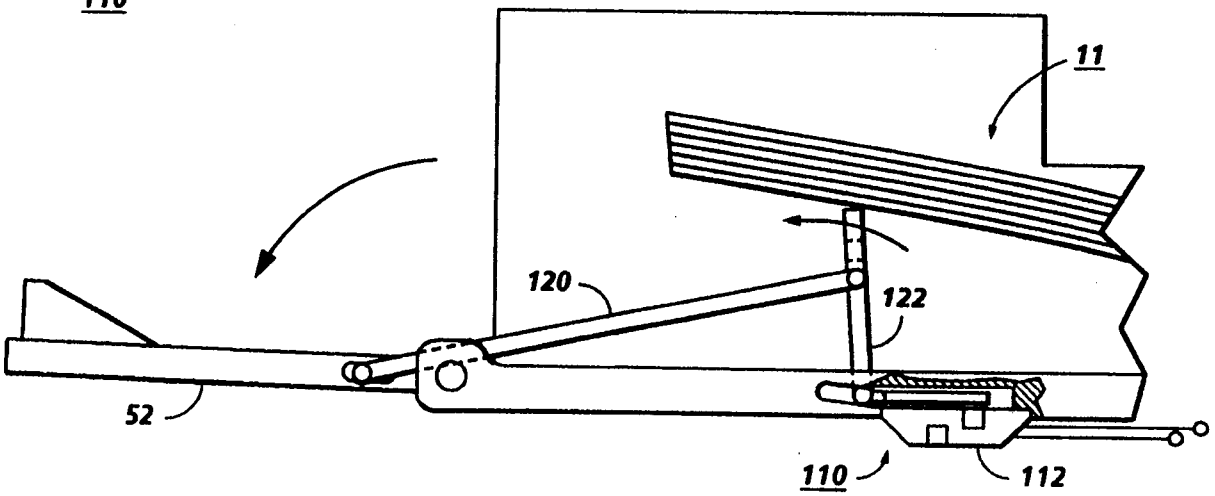
Figure 13A:
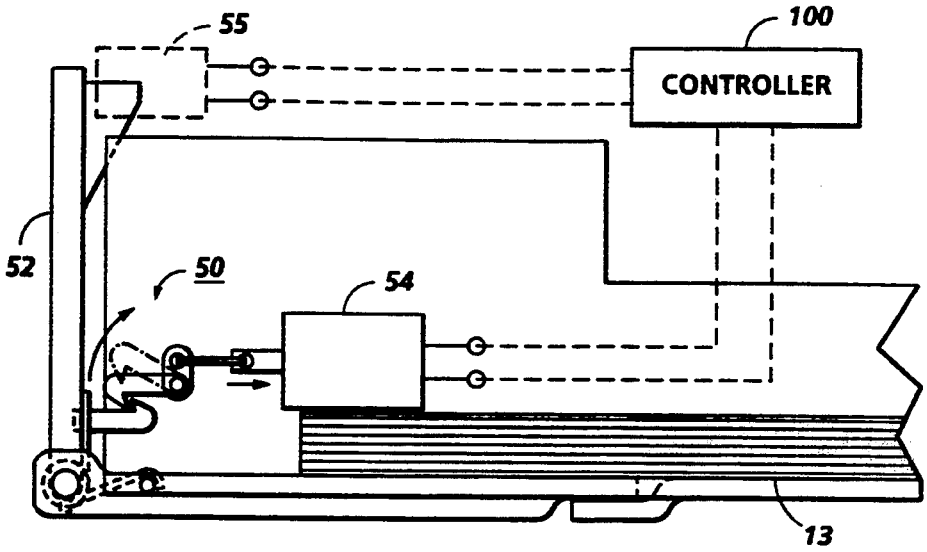
Figure 13B:
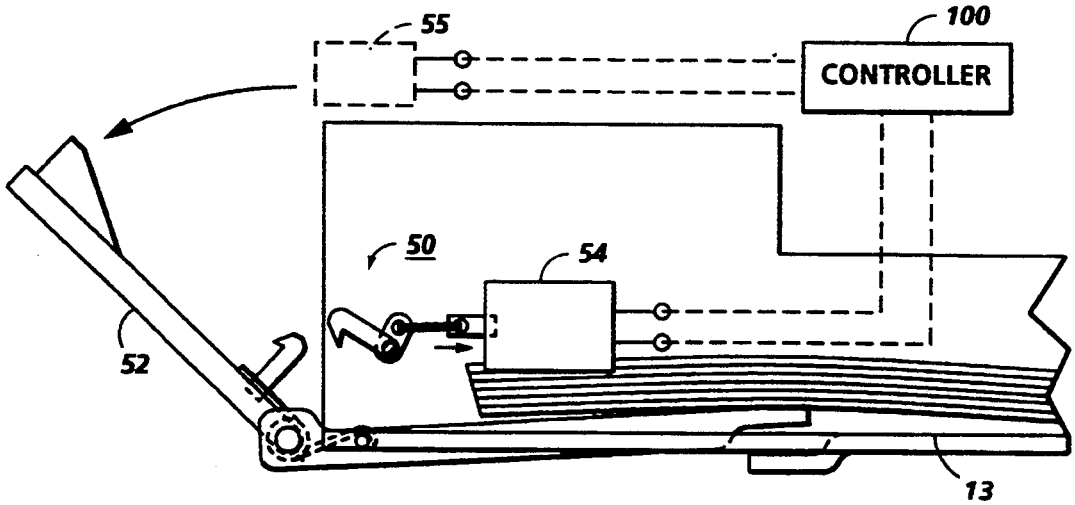
Figure 14:
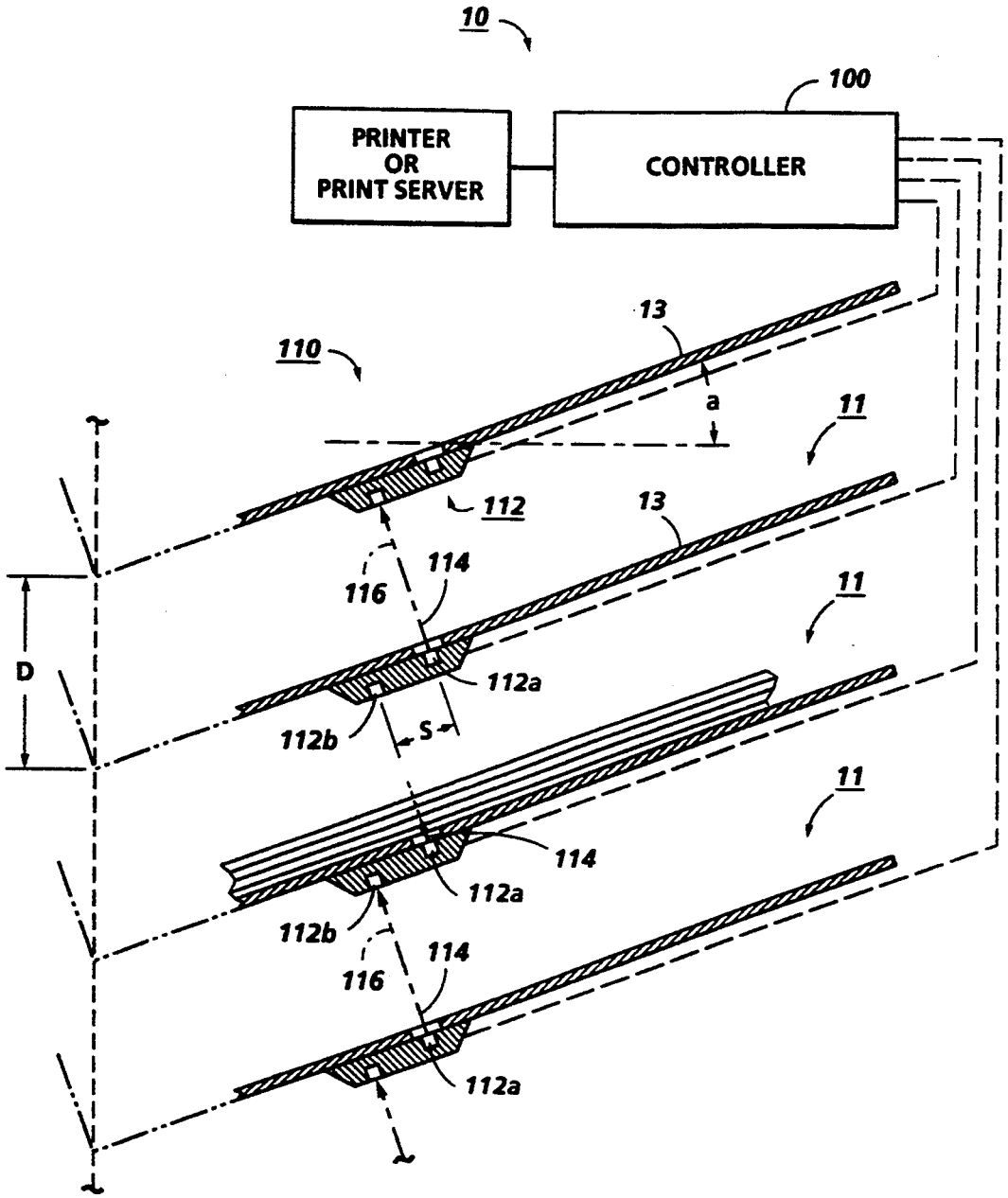
Figure 17:
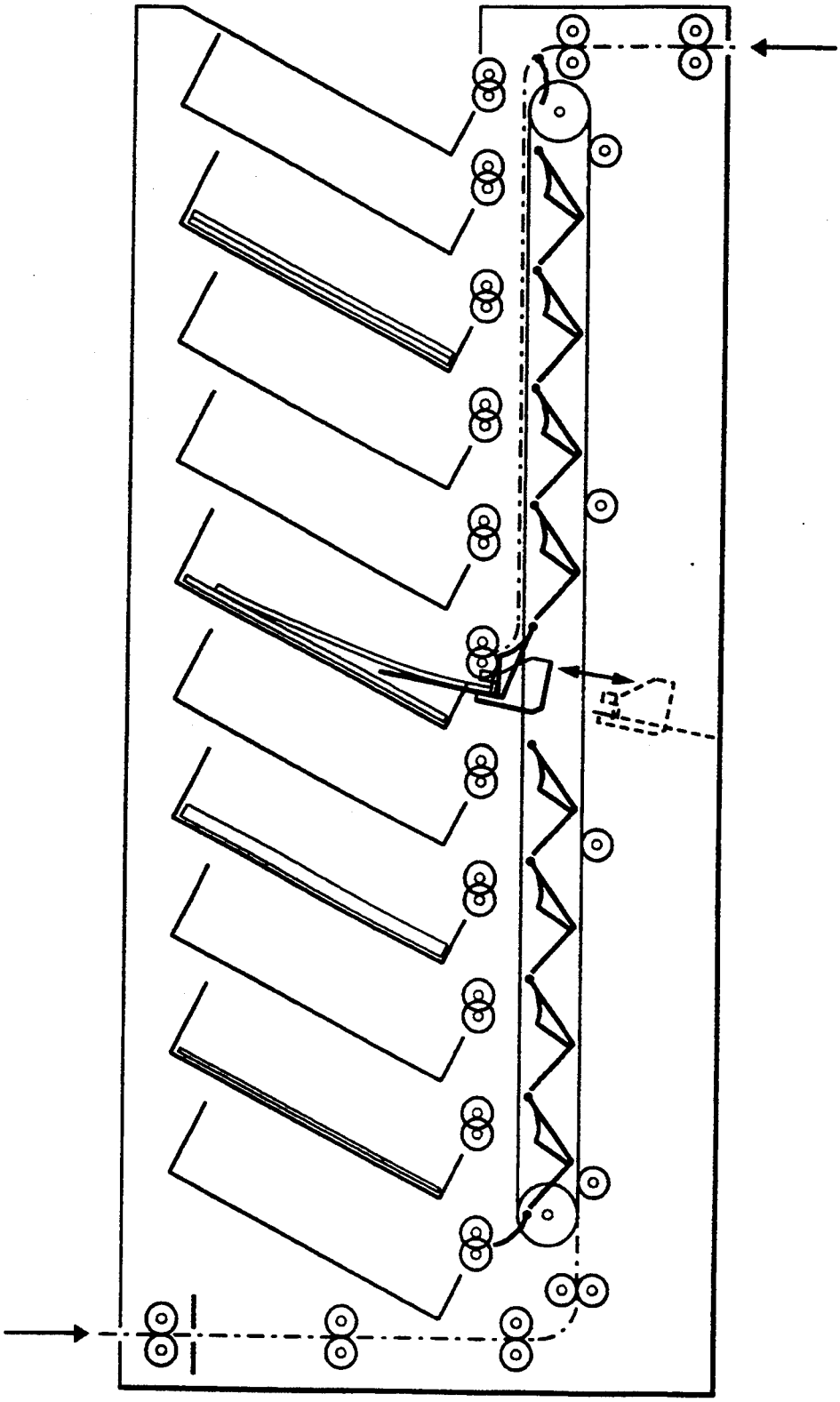
Figure 18:
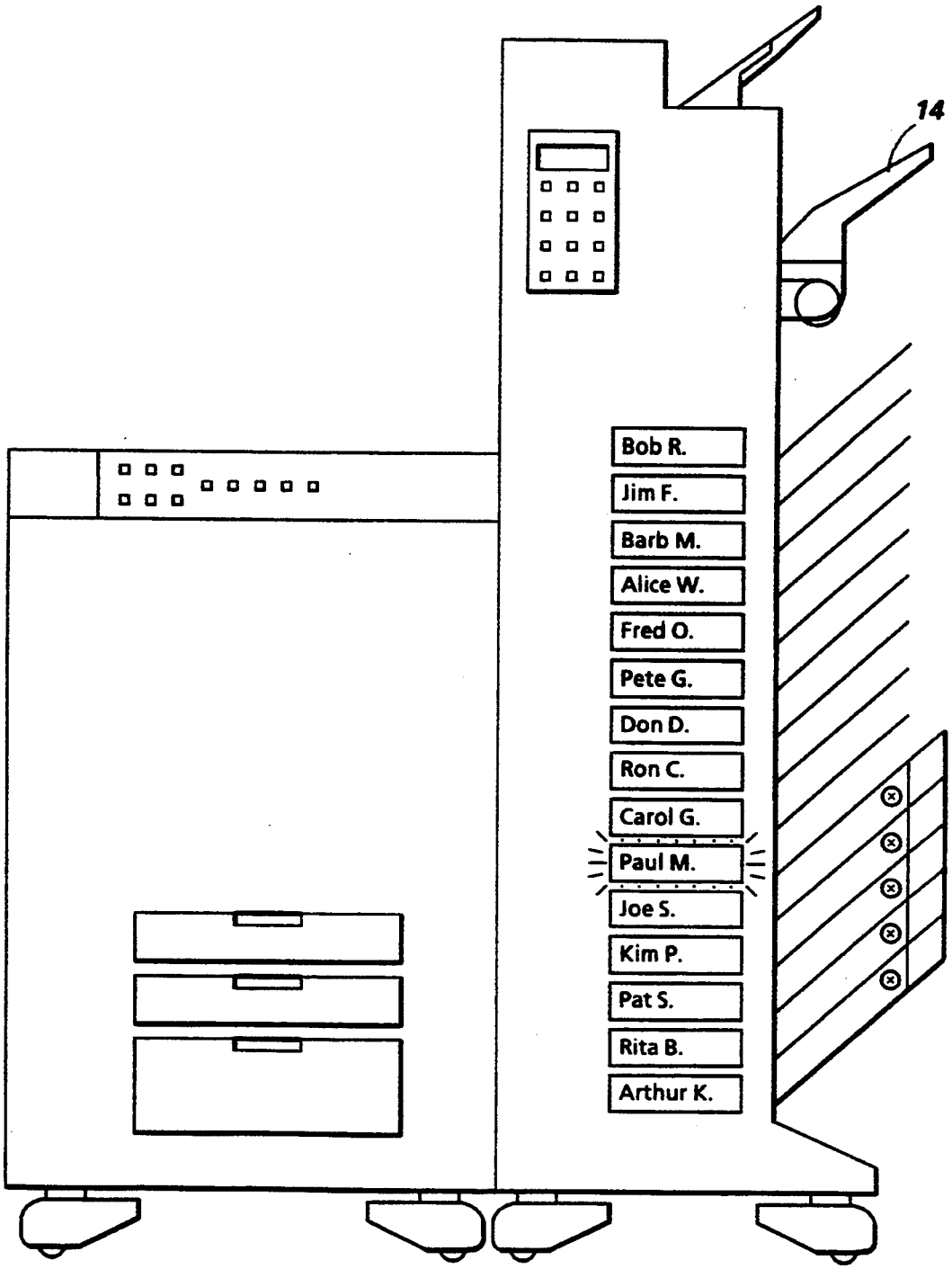
Figure 19:
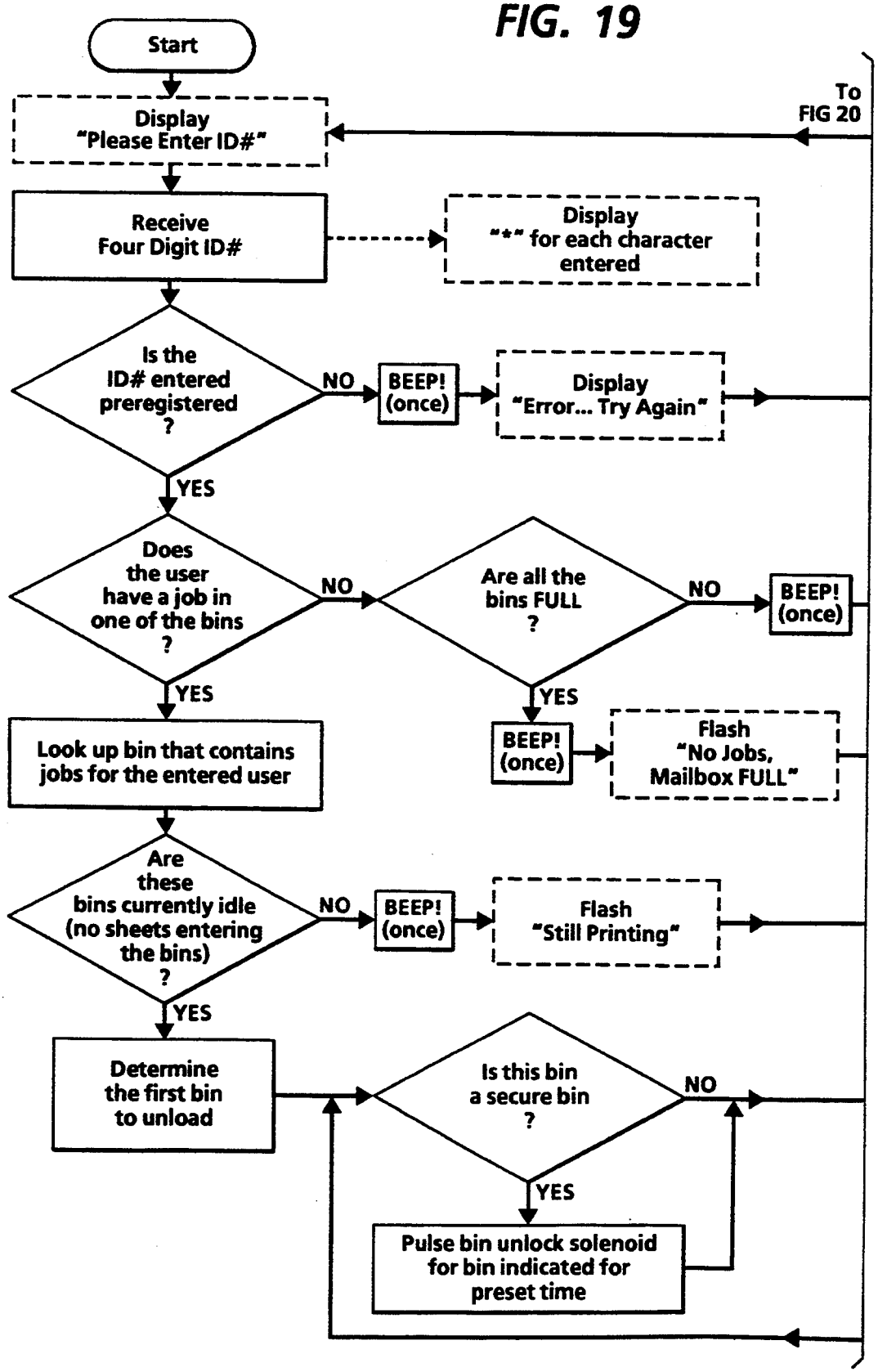
Figure 20:
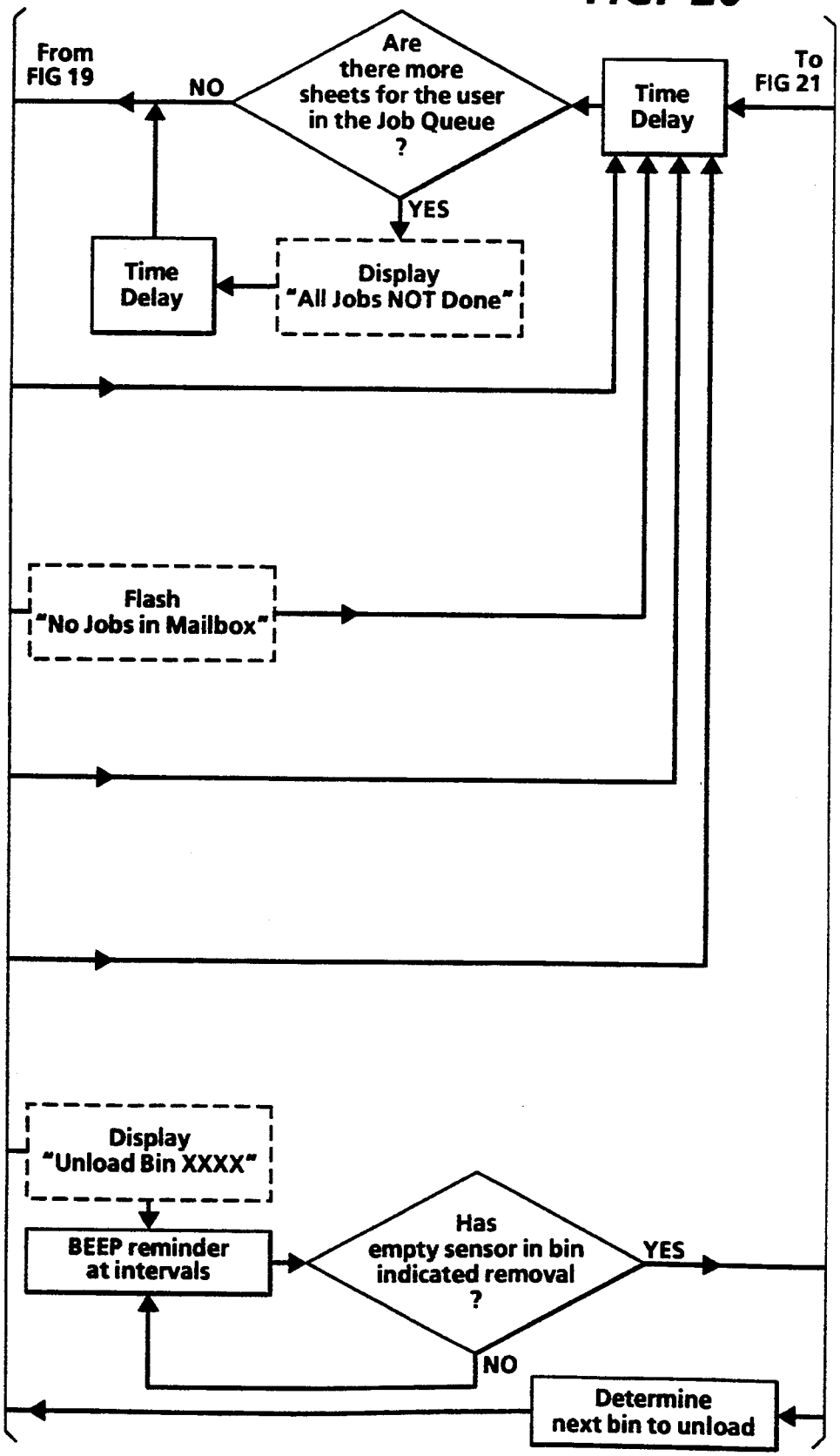
Figure 21:
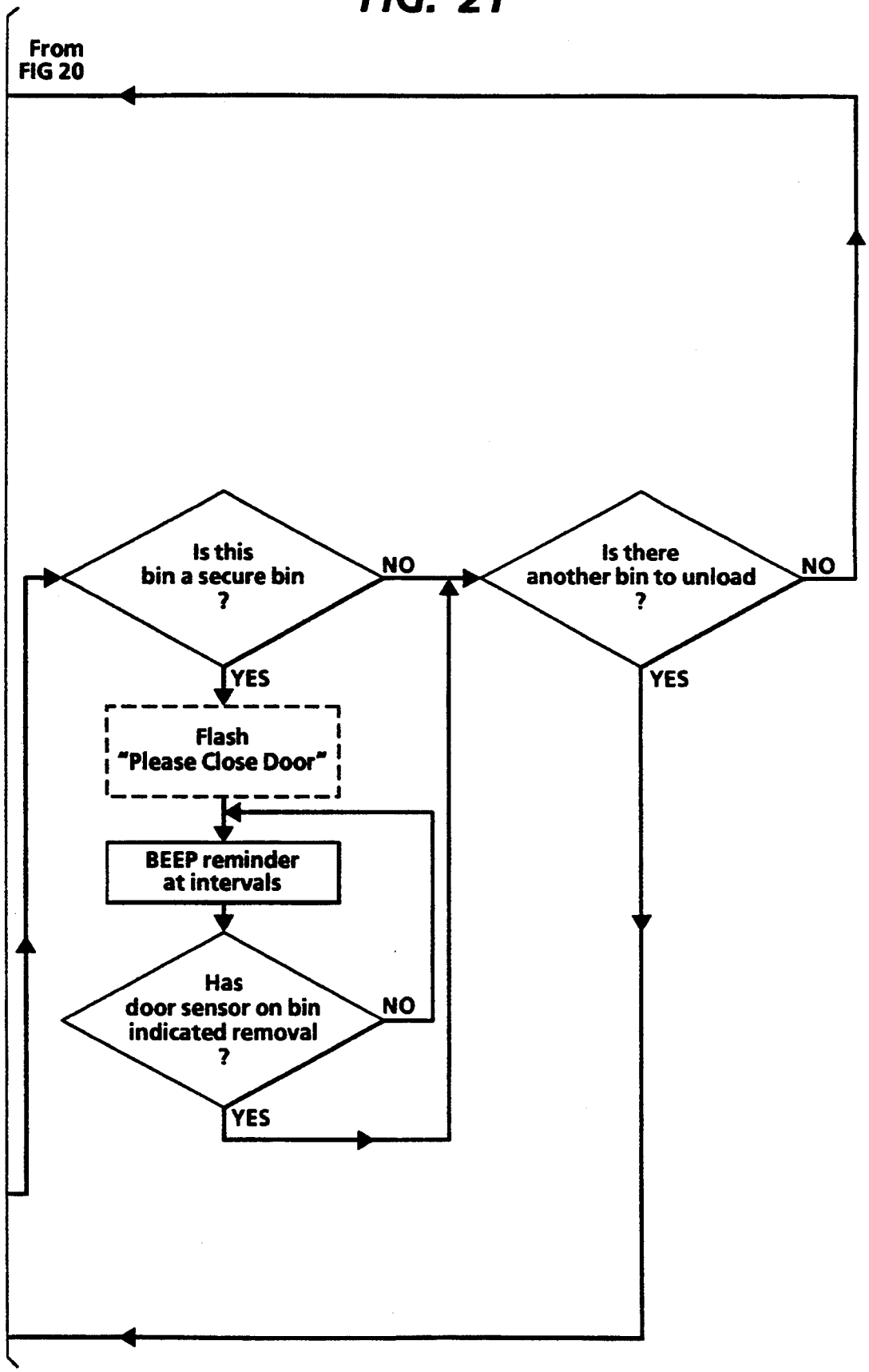

FIGS. 4A–4C are three schematic frontal views of modifications of the modular mailboxing system of FIGS. 1–3, showing how it can be rearranged into different configurations by changing sub-modules, such as by adding an open top tray and a selectable mixture of locked and unlocked mailboxes at different locations, and a large capacity stacking tray, with or without a tray elevator, all interchangeably mounted on the same support frame [FIG. 4C is also shown with a right hand and top interface module for sheet input feeding from a printer left side output similar to that of FIG. 1];

FIG. 5 illustrates exemplary electronic information interchanges between the exemplary mailboxing system controller and the associated printer controller and/or its print server;

FIGS. 6–8 together provide an exemplary flowchart and electronic signals logic diagram for determining variable bin assignments for the subject mailboxing systems, which may also control the user bin display and bin unlocking, as also described herein;

FIG. 9 (A and B) is another example of a mailboxing system, with a job set compiler/stapler which may be stationary in a mailboxing unit with an array of vertically movable bins, [or with partial movement of both]. FIG. 9A shows a job set being compiled, and FIG. 9B shows the compiled set being ejected into the adjacent bin (using set ejector pushing fingers in this embodiment). Two optional sheet inserters for book covers or other inserts are also schematically shown here in a replaceable top sub-module [which could also be provided in other embodiments herein];

FIG. 10 is a partial, broken-away, enlarged perspective view of one example of bin "privacy doors" usable with any of the illustrated mailbox embodiments to provide so called security or lock-box mailbox bins with restricted user access, and also illustrating an integral job set lifter system for automatically lifting up the front of a job set in a bin with an opened bin door;

FIGS. 11A–11C are side views of three sequential door opening steps for the mailbox privacy door and set lifting system embodiment of FIG. 10;

FIGS. 12A and 12B illustrate in two positions a slightly different alternative embodiment of the set lifter system of FIGS. 10–11 and also illustrates a dual mode sensor system for both bin-empty and bin door closed sensing, in which a flag moves with the bin door opening 12B to block the sheet sensor of FIG. 14 from looking up into the bin;

FIG. 13A and 13B show an automatic spring-loaded, solenoid released, bin door opener system, also showing the set lifter of FIGS. 10 and 11;

FIGS. 14–16 show an exemplary bin-empty (available bins) sensor system, which, as shown in FIG. 16, as well as FIGS. 12 and 15, can also signal bins which are open. The logic diagram of FIG. 15 is usable with any such system, and in connection with FIGS. 6–8, as indicated there. FIG. 16 shows spring-loaded mailbox bins which automatically slide out like drawers when released by solenoid latches, as an alternative to privacy doors which pivotally open in bins which are stationary as in FIGS. 10–13;

FIG. 17 is another alternative mailbox module wherein the sheet deflector (bin selection) gates include the partial compiler shelf which extends into the selected bin;

FIG. 18 is another mailbox unit embodiment, shown with its associated printer, with flashing variable user name displays next to each job-loaded mailbox; and FIGS. 19–21 show another flowchart, providing one example of logic and operations for an exemplary mailbox unit's sensors and user indicators system.

Turning now to the exemplary embodiments of a mailbox unit shown in the Figures, it will be appreciated that these are merely examples of the claimed system. The printers to which the mailbox system may be operatively connected are only partially shown, or not shown, since various printers may be so connected, with little or no printer modifications, as part of various systems. Preferably the mailbox unit has an input which adapts or adjusts to various printer output levels, or an interface unit or interconnect transport may be provided in a known manner to sequentially feed the printer output sheets from the printer into the sheet input entrance of the mailbox unit. The illustrated mailbox bins, compiler, stapler, etc. illustrated or described herein are exemplary, and may very considerably. The general reference number 10 will be utilized below for the mailbox unit or module, even though modifications thereof are variously show herein. Likewise, the general reference number 11 will be used throughout for an individual mailbox (bin).

The disclosed systems provide for stacking the sheets sequentially outputted from the printer in separate job sets into one or more temporarily and variably assigned "mailboxes" of a "mailboxing" job sorting accessory unit having a number of variably assignable "mailbox" bins. In particular, there is disclosed in examples herein a dynamic "mailboxing" unit and system for dynamically separating into mailboxes by currently assigned users the sheet outputs of various users of a shared users printer (including facsimile receivers or combination units). A variable display indicates the bins into which that particular user's jobs have been placed last and not yet removed. These may be plural pre-compiled and/or pre-stapled job sets all stacked in one bin. The exemplary disclosed system may also provide a bypass for sequentially stacking unstapled user sheets directly in a mailbox without compiling and stapling. Also disclosed is automatic overflow assignments of additional temporarily designated bins for identified users, as needed, to provide effectively unlimited or "virtual bin" plural job stacking. An integral moving sheet deflector, compiler and stapler unit is shown for collecting, compiling, and optionally stapling, and ejecting job sets of sheets for separate designated users into one or more of these discrete but variably assigned "mailboxes". The disclosed "mailboxing" units may also have "privacy doors" locking for restricting access to at least some of the mailbox bins, with electrical door unlocking of selected bins in response to entry of a user access code, and other user features.

First, however, further by way of background, examples of overall office or other systems and/or networks in which one or more such mailbox units and their associated printers may desirably be incorporated will be discussed. As discussed above, a shared user printer output job can be generated and get to a mailbox unit from various sources. For example, customers can send a job to a printer from their respective workstations, e.g., from a screen display menu or job ticket, as further discussed herein.

Another potential job source is a facsimile document or message addressed or directed to that printer, preferably with a designated recipient's mailbox or other user code number sent with the fax message. [The print server or mailbox unit can also then send an acknowledgement message to the designated recipient's workstation noting that the fax has been received in that user's mailbox.] That is, the fax sender could enter a code from their fax transmitter (a fax unit or computer terminal), using, e.g., the number keypad, that would indicate to the receiving printer and its mailbox unit who the recipient is. The mailbox unit would then automatically put the printed fax job in the correct (assigned) bin. The phone modem (of the workstation, printer, server, or mailbox unit) could then call the designated recipient to send a recorded message saying that they have a fax. (If no such designator code is specified, the fax can go to an unlocked general use bin.) It has been suggested that since the CCITT G3 Standard for DIS/DCS FAX transmission signals has a 20 digit field for the send phone number, and only 10 digits thereof are normally needed for internal U.S. transmissions, that these normally unused field places could be used to send a known "mailbox" bin code number as part of the initial FAX transmission, for automatic feeding of that received FAX transmission to that designated bin of a fax receiver which is provided with plural output "mailbox" bins.

A print job can also be sent to another person's mailbox bin directly, without going to their workstation. For example, someone might want to send hardcopies of a contract that needs to be signed to other system users. Rather than just electronically mailing each of them an electronic copy, a print order with their mailbox designators can also or alternatively be sent to the printer for printing so that hardcopy is immediately printed and placed in mailbox bins assigned to them, as described herein.

By way of background on systems within which a mailboxing system may be utilized, the following Xerox Corporation U.S. patents include examples of systems with a network, server and printer [usually for shared user's remote terminals]: U.S. Pat. Nos. 5,153,577; 5,113,517; 5,072,412; 5,065,347; 5,008,853; 4,947,345; 4,939,507; 4,937,036; 4,899,136; 3,958,088; 3,920,895. Also, Fuji Xerox Co. U.S. Pat. No. 5,113,355. Also noted re a print server disclosure is IBM Corp. U.S. Pat. No. 4,651,278 issued Mar. 17, 1987 to A. Herzog, et al.

Also, noted for examples of printer controls are Xerox Corporation U.S. Pat. No. 5,133,048, and the October 1990 publication "The Xerox DocuTech® Production Publisher" from BIS CAP International, Newtonville, Mass., by Charles LeComte. Noted also are Xerox Corporation U.S. Pat. No. 5,170,340, and allowed U.S. Ser. No. 07/591,324, on networking thereof, and printed documentation on the HP PLC 4, et al. Additionally, noted is the Xerox printing productivity series: Elixir Edition for Highlight Color Version 2.10a that includes ElixiForm/ElixiSys, ElixiGraphics and ElixiFont.

Xerox Imaging Systems (XIS) in January, 1993, introduced multiplatform OCR software comprising a client-/server implementation of its "ScanWorX TM" Optical Character Recognition (OCR) software. As reported, "ScanWorX" converts hard copy documents to standard formats such as "FrameMaker TM", "Interleaf TM" and "WordPerfect TM" as well as user-definable outputs for databases. The software can be used with a scanner for stand-alone document recognition or as the recognition component in a Document Image Management (DIM) system. It has the ability to run on HP, IBM, Intergraph and Sun platforms. The "ScanWorX TM" distributed architecture also permits sharing of OCR processing loads across UNIX networks. "X-Windows" TM support enables inclusion of Macs TM and PCs in "ScanWorX TM" networks.

By way of further, early, background, the concept of various scanned paper or electronic imaging transmission input devices selectably electronically interfaced or networked to a flexible modular printer was disclosed in Xerox Corporation U.S. Pat. No. 3,597,071, filed Aug. 30, 1968 and issued Jul. 27, 1971, on a "Diverse-Input System". Also noted is IBM Corp. U.S. Pat. No. 4,623,244 issued Nov. 18, 1986 to Donald R. Andrews, et al., originally filed Oct. 4, 1976, on copier or electronic printer input and controls, including plural image sources.

Also noted re commercial network systems with printers is the 1992 Xerox Corporation "Network Publisher" version of the "DocuTech®" publishing system, including the "Network Server" to customer's Novell® 3.11 networks, supporting various different network protocols, and "Ethernet TM". Also, the Eastman Kodak "LionHeart TM" systems. A network publication noted is "Mastering Novell® Netware®", 1990, SYBEX, Inc., Alameda, Calif., by Cheryl E. Currid and Craig A. Gillett. Also, "Print (Almost) Anything Anywhere", "DATAMATION", Newton Mass., Sep. 15, 1992, especially noting the IBM Pennant Systems Co. "Print Services Facility/2" (PSF/2) intended as a universal translator for routing almost any document from any platform to any printer.

Further noted re page description languages (PDL) (for printers and systems) are "Interpress TM: The Source Book", Simon & Schuster, Inc., New York, N.Y., 1988, by Harrington, S. J. and Buckley, R. R.; and Adobe Systems Incorporated "PostScript® Language Reference Manual", Addison-Wesley Co., 1990. Also noted is the Apple Corp. "Quickdraw TM" software and its published materials.

As is noted in art cited above, the control of, and software for, printers in a system or network environment can be in the printer itself. Commonly, however, a major part of the system printer integration software operation may be in a "print server" connected into the system, (typically a stand alone or dedicated shared small computer or PC). Another name for or type of unit providing print server capability or functions is a "shared interface unit".

Printers (and printer controllers or servers) are also sometimes referred to as "shared resources" in a networked environment. The server typically functions as a "spooler" to buffer the jobs that are sent to it, as well as a page description language (PDL) "decomposer", for converting the PDL files (e.g., "Interpress TM" or "PostScript"®) to bitmapped files for application to the printer.

Another example of an established commercial integral system, with a shared printer and system server, comprises the Xerox Corporation "VP Local Laser Printing" software application package, which, together with the Xerox "4045" (or other) Laser Copier/-Printer (CP), the "6085" "Professional Computer System" using Xerox Corporation "ViewPoint" or "GlobalView®" software and a "local printer [print service] Option" kit, comprises the "Documenter" system. The laser printer prints text and graphics with high quality resolution on a variety of paper sizes and special papers, including transparencies, labels, and envelopes. [When equipped with the optional copier feature, the "4045" CP also alternatively provides quick copies, functioning as a copier.] Printing occurs as a background process, enabling system users to continue with other desktop activities at their terminals. VP Local Laser Printing software can be loaded at a networked, remote, or standalone Xerox "6085" Professional Computer System (workstation).

The even earlier Xerox Corporation "8000" "Xerox Network Services Product Descriptions" text further describes other commercially available Xerox Corporation electronic document printing systems. It notes that such document systems can support the capabilities of remote workstations, PC terminals, and facsimile devices, and connect them for shared use of an electronic printer, usually via a print server and/or shared user interface formatting print service. The software system can also control local print job queue management, etc. The print service will accept a print job from any device with access to the network which can be formatted or reformatted to the Xerox "Interpress TM" [or other such electronic printing standard or printing protocol]. It allows the client to submit a printing job, including an "Interpress TM" or other such standard master and a number of job parameters, such as paper size, number of copies, and device-specific information. The printing protocol also allows the client to query the print service regarding the status of the job, for user notification.

The electronic printing standard includes a specific set of instructions for printing in a standard for representing documents digitally. The "Interpress TM" standard for representing printed pages is already supported by a wide range of Xerox Corporation and other products. The print service understands and processes "Interpress TM" instructions received from a workstation, transforming them into a format understood by the printer. The Interpress TM standard is comprehensive;

it can represent any images that can be applied to paper (including complex graphics) and a wide variety of font styles and characters. Each page of an "Interpress TM" master can be interpreted independently of others. This allows a user to easily produce new masters from existing ones and allows the printer to selectively print pages from any master it receives.

Although a "formatting print service" may not have a printer directly attached, it can perform much the same as a print service that does. The typical principal difference is the transferring of an Interpress TM master into an internal format understood by the printer. The formatting print service creates a secondary "Interpress TM" master which accurately represents the same image but in a subset of "Interpress TM" which can be directly processed by the designated or target printer. This secondary Interpress TM master is then transmitted to the formatting print service's target printer for processing and printing.

Workstations on the network with conversion software can interact with the print service. This software runs automatically when users request that a document be printed. It converts the document format used by the workstation into an "Interpress TM" master which is transmitted to the print service. This transfer is implemented by a network queuing subsystem which implements the printing protocol and interfaces with an internal print queue for the tracking of the Interpress TM master. The internal print queue facilitates the movement of documents through the various stages of processing. The queue can hold a large number of documents, which are processed in the order received, or can be reprioritized. Generally, a print job is available in the printer's output tray within minutes after the user initiates the print request. The user can see the status of a print job and its place in the queue by making a request through the print server terminal or at the workstation. The resulting display will tell the user whether the job is being queued, formatted or printed. Once the document has been printed, the print service can delete the "Interpress TM" master.

The "Interpress TM" master is also accompanied by properties and options which specify document name, user name, and creation date. The print service interprets the master and then directs the printer during the printing process. This process involves several stages: queuing, formatting, and either printing, transmitting (in the case of facsimile print service) or forwarding to another print service (in the case of the formatting print service). During the printing or Fax transmission stage, messages may be generated to report any problems with the printer, such as a need to replenish the paper supply.

Different workstations can access the print service in different ways. To print a document, desirably the user can simply "copy" or "move" the document, with a mouse click or other command, to a printer icon on the workstation desktop, and set the displayed printing options, as on Xerox Corporation workstations. From other workstations such as the IBM PC's, the user may need to select menu items or type in commands to obtain access. The workstation selectable print options can include the number of copies, selected pages to be printed, paper size, image orientation, a choice of printers, and phone numbers when sending to a facsimile device. In addition, the option sheet allows the user to specify whether to delete the "Interpress TM" or other master, or retain it at the workstation desktop. Already print-formatted or master documents may be transmitted to the printer directly, eliminating the need to repeat the conversion or decomposition process if another copy of the document is desired. If saved, an "Interpress TM" master can be stored at the file service or even mailed to one or more individuals via an electronic mail service.

Utilizing an inter-network routing service, users can transmit "Interpress TM" or other printing masters through a network and/or then across an internet to another local area network. Either may employ telephone lines, twisted pair wires, coaxial cables, microwaves, cellular telephones, infrared transmitter/receivers, and/or other data links; allowing documents created in one location to be automatically routed to a print service and printer locally and/or remotely hundreds or even thousands of miles away, in seconds. [Any of these data transmitting media or vehicles may also be used between the mailbox unit and it's associated printer and/or print server.]

Describing now in further detail the exemplary embodiments with reference to the Figures, first there are shown various embodiments of a standalone printer output "mailbox" job sorting unit 10, with plural bins 11, and an integrated job compiler finisher unit, such as 90, by way of examples thereof. The conventionally sequentially received hard copy of plural page documents from a pre-collation output electronic printer or the like is fed into the mailbox unit 10 and automatically controlled for the particular bin 11 assignment destination of the job sheets. The mailbox unit 10 directs all designated sheets of a users job to available bin or bins 11 temporarily assigned to that printer user based in availability.

As noted, the disclosed mailbox unit 10 can be a universal or dedicated stand-alone unit that is attached to, or even simply moved next to the output of almost any conventional printer. Plural units 10 may be ganged in series like plural sorters, if desired, for increased numbers of bins, using conventional sheet pass-through feeders and gates. As is well known in sorting in general, sorter bin units can be extended or serially connected in this manner to provide more available bins, if desired. On some facsimile receivers or other printers, it may be necessary or desirable to first remove an existing output catch tray. That output tray is often an easily removable "hung on" plastic unit. No electrical or mechanical linkages or interconnections are necessarily required. The job sorting unit 10 can take sheets inputted at one or more sheet inputs 20 from various printer outputs, including multi-functional units. The input 20 may, if desired, be provided with a pivotal or otherwise vertically adjustable input ramp and/or feeder, which may be in an interface module, to align with various levels of printer outputs. Left and right side sheet inputs may be adapted to operatively engage with the sheet output of the shared user printer at different levels on either of two opposing sides of the mailbox module so as to universally accept many different printer outputs and output levels. The input 20 may include, for example, an input feeder 24 to first feed the incoming sheets to the top of the unit. As illustrated here, that may employ the outside flight or bight of the conventional vertical frictional sheet transport belts 26 feeder as shown in FIGS. 4A, 4B and 9, for left-side sheet input, or an interface module 16 or other vertical feeder for right side input as in FIGS. 1 or 4C. Since the output of the printer may be acquired sequentially as individual unstacked sheets as it outputs, no sheet separator is required for the unit 10, and thus a very simple input feeder can be used. It can even be positioned to reach into the pre-existing sheet output tray of the printer to pull the sheets out of that tray. The unit 10 input feeder 24 preferably has a conventional sheet input sensor actuated by sensing the entrance of a sheet lead edge into a sheet entrance path 20.

The internal sheet feeding in the mailbox unit 10 can utilize various known sorter sheet transports, many of which are shown in cited art herein. Once each output sheet of the printer has been acquired by the input feeder 24 or the like of the unit 10, the further feeding may be done conventionally by the illustrated rollers 25 engaging belts 26 to form feed nips feeding the sheet along the belts 26 until the sheet meets a bin selection and feeding means 30. Here, preferably the inside flight or bight of the moving belts 26 carries the sheets thereon downwardly from the top of the unit past a series of gates or sheet deflectors 32, until the sheet is deflected into a selected bin 11 when the sheet reaches an opened gate 32 adjacent the selected bin or tray 11 entrance, as further described below.

As noted, various components of the mailbox unit 10 can be conventional, even commercially available, except as controlled and modified as described herein. Various feeding and gating arrangements whereby inputted sheets are fed to and gated into selected bins, by a moving gate or separate associated bin gates, as here, with a sheet deflector mechanism, from a sheet transport, are well known in the art. Shown here is a movable frictional belts 26 transport system and plural stationary but pivotal sheet deflectors 32 to selectably deflect sheets from the feed belts 26 into the selected bin 11.

As noted, the entire operation of the exemplary mailbox module unit 10 here may be controlled by an integral conventional low cost microprocessor chip controller 100, conventionally programmable with software for the operations described herein. Such a system has ample capability and flexibility for the functions described herein, and also for various other functions described herein, if desired, such as jam detection and jam clearance instructions.

In the system herein, desirably several, or all, of the bins 11 are partially or fully enclosed, with a normally locked privacy door 52 openable on one side (or end) by a bin door unlocking system 50, as will be further described.

Optionally, the top bin or tray 11*a* of the unit 10 may conventionally provide an open or "public" bin. A top bin is preferably used for undesignated or unknown user's jobs, jam purges, etc. since it is not limited in stack height by any overlying tray.

As noted above, and as illustrated by the differences between various Figures here, the mailbox unit 10 is preferably a modular or stand-alone unit, which however, may also be flexibly modifiable into different tray/bin configurations and spacings. Examples of systems for variably mounting shelves and/or movable sheet stacking trays to the same frame unit are shown, for example, in the above-cited Mandel et al. U.S. Pat. No. 5,098,074, and the above cited U.S. Pat. No. 3,907,279. Other such variable shelf mounting systems are well known for wall-mounting bookshelves, e.g., a fixed vertically slotted track into which the "J" shaped ends of bookshelf or rack supports are cantilever mounted.

Some examples of the various mailbox unit 10 reconfigurations possible with this system are shown in different Figures especially FIGS. 4A–4C. As shown, the mailbox module unit 10 proposed here flexibly enables a wide variety of output configurations that can accommodate various requirements. The numbers of relatively low capacity (e.g., 100 sheet) mailbox bins provided for a number of individual printer or fax shared users may be fabricated in modules of 4 or 5 bins each which can be easily added or removed from the unit 10 main frame. However, as shown, one or more illustrated stacker tray 14 systems can also be mounted (vertically superposed) onto the same frame in place of one or more of these mailbox bin modules, to provide a large vertical free space for providing high capacity stacking. This desirably provides multiple stapled sets stacking capability from the same compiler unit/stapling carriage such as 90 that also interfaces with the mailbox bins. That is, the inputs to stacking trays 14 are approximately vertically aligned with the inputs to bins 11. This accommodates host-connected printers where high capacity stackers are desired. Especially, printers used as "departmental" printers rather than individual addressed mailboxes, so as to require less bin output locations.

However, here, instead of the stacking tray 14 conventionally moving down as it fills to maintain the top of the stack slightly below the compiler exit level, the present system can desirably move the compiler/stapler unit 90, or the like, up as tray 14 fills. This desirably allows a simple fixed tray 14 to be used, with no elevator mechanism for that tray 14, by using the same bin indexing elevator system as is also used here to direct jobs from the same compiler unit to selected mailbox bins 11. Alternatively or additionally, conventional elevator-moved stacking trays can be used, like those described in the above-cited Mandel U.S. Pat. No. 5,098,074 [34] or U.S. Pat. Nos. 5,137,265; 5,026,034; 4,541,763; or 4,880,350.

Another optional feature of the mailbox unit 10 (or an optional associated interface unit 16 between the printer and the mailbox) is to provide optional additional online sheet treatment subsystems in the mailbox module input sheet path upstream of the bins; such as a sheet rotator, sheet inverter, sheet hole punch, signature folder, Z-folder, sheet inserter, purge tray, etc., or some combination thereof. [These are all well known, per se, and need not be shown in detail here] They may be located in, e.g., a removable and replaceable top (or bottom) sub-module 10*a* of the mailbox unit, so as to be able to easily meet various customer needs by easily substituting one such functional sub-unit for another. For example, a sheet rotator may be located in the mailbox sheet input path as shown at 17 in FIG. 1. In general sheet rotators operate by moving one side of the sheet faster than the other, by holding or much more slowly feeding the sheet in one sheet feed nip on one side of the feed path than the other (as with a variable speed motor or drive) until the sheet rotates 90 degrees. Thus allows a choice of sideways or end-wise sheet bin 11 stacking, and/or selection of the side of the set to be stapled. In addition to the above-cited Mandel et al. U.S. Pat. No. 5,090,638, other sheet rotators are shown in U.S. Pat. Nos. 3,861,673; 4,473,857; 4,830,356 and 5,145,168; and some of them are shown in interface modules. EK U.S. Pat. No. 4,602,775 and Fuji Xerox U.S. Pat. No. 5,172,162 also show an interface module with an inverter or other sheet processor between a printer or copier and a sorter, finisher, or other output unit. Examples of on-line Z-fold and other sheet folder systems are in U.S. Pat. No. 5,076,556 issued Dec. 31, 1991 to the same B. P. Mandel. Examples of on-line sheet hole punching units include Xerox Corporation U.S. Pat. No. 4,819,021; and U.S. Pat. Nos. 4,998,030 and 4,763,167. Examples of sheet inverter patents include Xerox Corporation U.S. Pat. Nos. 3,833,911; 3,917,257; 4,359,217; and 4,673,176. The first two show an optional inverter in association with a sorter, in the Xerox Corporation "4500" copier. Examples of cover or other sheet inserters, etc., are disclosed in the Xerox XDJ publication of November/December 1991, pages 381–383; and U.S. Pat. Nos. 4,626,156; 4,924,265; 5,080,340; and 4,602,776. An example 18 here is shown in FIG. 9. Sheets may be fed from either of the illustrated FIG. 9 sheet trays and feeders at times selected by the printer or controller 100 to be interposed (interleaved) with job sheets from the printer going into the same sheet path to the same compiler/stapler.

If a large e.g., 17 inch, sheet is signaled by the printer as being sent, or detected by the mailbox sheet entrance sensor, then such a sheet can be rotated by a sheet rotator such as 17 or the like in the sheet path as described above, so as to stack short-edge first in a bin. Alternatively, if a sheet folder is provided in the sheet path, the large sheet can be folded before stacking. Thus, the mailbox bins need not be oversized just to accommodate such abnormal large size sheets.

As shown in FIG. 1, the sub-module 10*a* can also provide an alternate, gated, by-pass sheet feeder path 12 on through the mailbox unit into another mailbox unit, for increased bin capacity or further such sheet processing options in that further mailbox unit.

These optional additional sheet operating features may desirably be assisted by a unit 10 sheet feeding system in which inputted sheets are first fed up to the top of the unit 10 to submodule 10*a* (if any) in one sheet feeding path, before being fed down in another sheet feeding path to the bin selector system and/or compiler/finisher unit, as described [or, vice-versa for a bottom submodule].

These replaceable sub-module features can be provided here with either left or right side sheet input, yet can use the same mailbox unit frame and paper transports in any of these "universal" mailbox unit configurations. That is, the mailbox module can have a superposed array of plural mailbox print job collection trays for collecting the sheet output of a shared user printer, and also have a replaceable upper or lower vertically modular sub-module. The mailbox module can have both a right side and a left side for feeding sheets respectively from either left or right side sheet inputs vertically to the sub-module. The replaceable sub-module may have one or more interchangeable sheet processing-modules in the mailbox module sheet path to sequentially operate on sheets in that path; such as a sheet rotator, a sheet inverter, a sheet hole punch, or a sheet inserter. The mailbox module has a third generally vertical sheet transport path from this sub-module to the selected print job sheet collection tray. As noted, the mailboxing module also desirably has a mounting frame on which a variety of sheet collection trays may be different removably mounted at variable positions.

In the illustrated mailbox sheet diversion system 30 example of FIG. 3 as well as FIGS. 1 and 2, plural sheet diverter gates 32 are commonly mounted in line on rotatable shafts 33 to define plural gate units 34. The number and spacing of such gates/shaft units 34 equals the number and spacing of the bins 11. They are closely parallel to, and vertically spaced along, the plural belts 26 sheet transport. The same shafts 33 may also support the sheet path idler rollers 25 forming the sheet feeding nips with that side of the belts 26 as shown. However, instead of being conventionally directly adjacent the bins, the diverter gate units 34 here are horizontally separated from the bins here by the space for (width of) the moving compiler/stapling unit 90. When one set or unit 34 of the pivotal gates 32 is pivoted, the top surface 32*a*, including end fingers 32*b* of each gate 32, acts as sheet deflectors to deflect sheets off of the sheet transport belts 26 at that gate unit 34 location, and into (or through) the adjacent compiler unit 90 at that selected bin 11 location. The selected single line of gates 32 (one gate unit 34) is pivoted on shaft 33 by direct mechanical engagement of a cam actuator 35 on the elevator/compiler unit 90 with a gate opening cam follower 36 on the pivotal gate unit 34 shaft 33. This pivots said end fingers 32*b* of that set of gates 32 out through spaces between the vertical sheet transport belts 26 so that these fingers 32*b* are positioned to catch the sheets on the top surface 32*a* and deflect them off of the belt transport and into the compiler unit 90.

Meanwhile, all the other pivotal gates 32 are all gravity-loaded into a closed (vertical) position, in which their rear or left sides 32*c* function as sheet guides or baffles to maintain sheets on the transport belts 26 vertical path passing thereby.

When the compiler elevator moves the compiler unit 90 on to a different selected bin position, the previously opened adjacent bin gates reclose, and that other newly selected set of 34 gates 32 is pivoted open. This eliminates the requirement for multiple solenoids, one for each bin, and their wiring for bin selections. Here there are plural, but dual mode, gates, which are individually cammed open one at a time by a moving compiler unit, which also forms part of the sheet path into the selected bin. Thus, this unit 90 here actuates, and forms part of the sheet diversion and bin selection system 30. [Note, that moving gate sorters (e.g., Norfin Co. Snelling, et al. U.S. Pat. No. 3,414,254) are known in the sorter art. However, typically these have only a single non-pivotal gate, per se, having one set of non-pivotal deflector fingers between the bins and the belt and/or vacuum sheet transport, always extending into the belts, which single gate is moved up and down past the bins by an elevator mechanism]. In contrast, here the compiler unit 90 is vertically moved up or down to its adjacent bin, not the gates. Similar known elevator systems may be used for the compiler/stapler unit here, such as elongated screw shafts rotated by a motor at their top or bottom, or a driven cable belt and pulley system. In the latter case, the compiler unit can conventionally slide up and down on conventional vertical elevator rails or smooth cylindrical rods.

Referring particularly to FIG. 2, as well as FIGS. 1 and 3, the example here of a sheet job set compiling and stapling and/or ejecting system 90 herein per se may be, for example, similar to that disclosed and described in Xerox Corporation application Ser. No. 07/888,091, filed May 26, 1992, by the same Barry P. Mandel, et al. (D/91697); [Another such compiling and stapling system is disclosed in his above-cited U.S. Pat. No. 5,098,074]. The sequentially incoming sheets from the sheet deflecting or bin gating system 30 here are fed into an input feeding nip 91 of unit 90 in all cases. However, then here the sheets are either fed directly through the compiler/stapler unit 90 on into the adjacent bin 11 without compiling or stapling, as shown in the dotted line path in FIG. 1; or the sheets may first be compiled in a compiler tray 92 by dropping and being fed backwards and registered against the downhill stacking rear wall 92*a* of the compiling tray 92. During this set compiling and registration, a compiled set discharge arm device 93 (with its driver roller 94) is in an up position out of contact with the discharge idler roller 95 (at the compiler tray 92 outlet), as represented by its illustrated solid line position. That is, during this compiling cycle, this set discharge arm device 93 is in an up position not in contact with any of the sheets in the compiling tray 92. [Note that if sheets are being sequentially fed straight on through the compiler 90 to the bin 11 without compiling (in a bypass or sorting mode), rollers 94 are held down in engagement with rollers 95.] Once the incoming sheet has been discharged from the sheet entrance rolls nip 91 and drops onto partial compiler tray 92, and slides downhill, the top surface of the incoming sheet is then also contacted by a rotatable frictional flexible compiler belt 96, causing the sheet to be driven back and downhill until it is fully registered against the rear wall 92*a* of the tray 92. This type of compressible open or "floppy belt" jogger or compiler assistance is further disclosed in Canon U.S. Pat. No. 4,883,265, (issued Nov. 28, 1989 to N. Iida, et al.), and U.S. Pat. No. 5,137,265, and EPO 346851. Each subsequent job sheet is compiled on top of the prior sheets on tray 92 in this manner. A conventional lateral registration tamper can also be provided, as in the cited art thereon. That is, once each sheet is discharged and rear registered by the rotation of the floppy belts 96 against the topmost surface of the sheet in the compiling tray 92, the lateral tamper engages to shift each sheet to a lateral registration edge of the tray 92. Because the floppy registration belts 96 are so flexible, and are held only at their top, they are easily deformed in the lateral direction. Note that even during this compiling operation the sheets also partially extended and hang out into the adjacent bin 11, saving overall mailbox width. That is, the compiler tray 92 is only a partial sheet supporting shelf for most sizes of sheets, as in the above-cited Mandel U.S. Pat. No. 5,098,074 or Canon U.S. Pat. No. 5,137,265.

Although not shown in the system 90, it may be possible to alternately use an elongated generally horizontal extension of the gates 32 as at least a part of the partial compiler tray 92, if desired. It can be constructed to pivot partially into the selected bin for compiling, if desired, as shown in FIG. 17.

Once the compiled set is completed (the entire job set is stacked) and both longitudinally and laterally registered, the compiled stack may then be attached together, by means of a stapler 97, or stitcher, or other suitable set binding device, such as is shown in the art cited herein. As shown in that art, and otherwise well known, stapling or other binding may be in one corner of the set, or along one edge, or along a central spline as a saddle stitch. However, set stapling is not required here. Whether stapled or not, the discharge device 93 is then automatically lowered onto the top surface of the completed compiled set to form a nip gripping the set between its discharge roller 94 and eject idler rollers 95, as represented by the phantom line position of 93. The compiled (and normally stapled) set is thus driven out of the compiling tray 92 and fully into the adjacent bin 11 to stack on tray bottom 13.

The set discharge device 93 here is exemplary. Set discharge could also be accomplished by a transport belt, mechanical pusher fingers [as in FIG. 9, shown moved out in 9B relative to 9A], or other suitable set transport device. Here, after a set ejection, the sheet discharge nip 94, 95 opens as the device 93 lifts to return to its initial position, and the compiling apparatus 90 is ready to compile another subsequent set of copy sheets thereon after being moved to another bin.

Thus, there is provided integral the mailbox unit a single repositionable compact compiling/stapling unit 90 for stacking, registering and attaching sets of printing machine output. The copy sheets may be discharged into an inclined compiling tray and each sheet assisted to be registered. Each sheet may also be laterally shifted by a tamping mechanism. The compiling tray level and/or sheet input level can be adjustable, if desired. Once a complete set of sheets has been stacked and fully registered, the stack may then be attached by stapling or other means, or not, and discharged as a set from the compiling tray into the adjacent bin. The system then returns to its initial position to sequentially accept and stack the next set of copy sheets. However, as noted, this is a plural mode operating system, which can also function as a single sheet pass-through feeder, feeding sheets directly sequentially into the bin 11 to stack therein.

As noted above, if desired, the compiling/stapling unit 90 can increment up after set ejection by a vertical distance related to the set sheet count, so as to eject the next set into that same bin from a higher level, for stacking assistance, especially for a higher capacity bin or a stacking tray 14 as discussed further herein.

As shown in FIG. 1, on a convenient upper surface of the mailbox unit 10 may be located a conventional numerical keypad 102 and adjacent LCD or other operator display 104. Both are operatively connected with the mailbox unit 10 controller 100, as will be described. The term "keypad" as used herein is intended to encompass any simple or low cost type of conventional numeric or alphanumeric keyboard, CRT touch-screen areas, or other keystroke capturing devices, or voice input alternatives. Also, the keyboard in the printer user interface (UI) may be used.

The above-cited co-pending commonly assigned applications Ser. No. 07/933,640 and Ser. No. 07/933,831 provided examples of simple programmed user interfaces (all with the same, single, simple keypad) which are also usable with the disclosed mailbox units. Passwords can be changed at any time desired, except during receipt of a print job. Passwords are desirably required to be entered for unlocking any locked bin. Initially assigned four number or other passwords can be readily changed using conventional software techniques. In such control software, an old password can be replaced by a new password and the software can match the password entered by a user with the one saved in the memory for that user. Matching of a password prompts a locking mechanism to unlock the specific bin. Different passwords are normally needed for different user bins, but can be shared, and/or combined into "master key" passwords. A bin privacy door locking system, such as the one's described herein, can allow several bins be automatically opened at once or one by one after entering the passwords. If desired, a separate key operator accessible mechanical unlocking system for all the bins (as by pivoting open the entire side of the unit), can also be provided in case of jams or power failures.

An alternative system of changing passwords is to send it via the system network, and/or use a printer encoded cover sheet, rather than a keypad entry. A pre-arranged or specially printed code pattern on a cover sheet from the printer can be read by the optical sensors in the sheet input 20 connected to the controller 100 to tell it to read other subsequent marks on the same or a subsequent cover sheet so as to enter that information into memory as a new password, rather than read the marked or printed pattern as a job bin assignment cover sheet code.

The user pin or code number can be the users existing network entry or "log on" password, identifiers or addresses. As previously noted, systems user identifiers are already automatically associated with each print job from that user in existing systems.

This bin locking and unlocking system may preferably, but need not necessarily, require separate, individual solenoid or cam operated latches for each bin, as shown, for example, in FIGS. 13 and 16. Movement of the compiler unit can also be used to provide bin unlocking by camming open bin door lock latches, for example. Or a positionable notched locking belt may be used as described in the above-cited U.S. Ser. No. 07/933,640 or Ser. No. 07/933,831. Another example of an electrical locking and bin unlocking system is described in the above-cited EPO published application No. 0 241 273.

As shown, for example, in FIG. 13 or FIG. 16, the bin locking and unlocking system 50 may comprise simple solenoid bin door latches 54 with simple spring loading to pop each selected door 52 open, and conventional cam or door striker relatching when the door 52 is manually closed. Sensors 55 may be used to tell if that door 52 is open or closed, such as conventional optical slot sensors which are blocked by the illustrated tab on the door being in the sensor slot when the door is closed. However, as also disclosed herein, this extra sensor and its connection to control 100 is not required, since a system of dual mode sharing of the "bin empty" sensor for this additional function is also disclosed herein.

Bins with doors which are open signal controller 100 to not feed further sheets therein until they are closed, for jam and safety reasons. A function of locked or restricted access bins with normally closed access doors is to prevent users from putting their hands into a bin area where and when the compiler/stapler unit is operating there or in an adjacent area, or at all, if desired. I.e., an immediately subsequent print job for the user unloading their bin can be routed to another, newly assigned bin, or the printer can be directed by controller 100 to stop printing any jobs for that user, or the printer can be directed to stop any printing until all bin doors are closed. Of course, separate safety switches can also be used.

There are various ways in which customers can be directed or assisted to find their "mail" at their assigned mailbox 11 locations. Automatic bin door opening is desirable for that, and is discussed above and below. The customer can additionally or alternatively look at the mailbox user interface (UI) liquid crystal (LCD) 104 or other display. The UI 104, when actuated, may, if desired, scroll through all the various customer names and bin locations of customers currently having jobs in the mailbox unit. Or if anonymous security is desired or selected, the user can be required to enter their access number in order for the job bin(s) location to be displayed. As noted, if locked bin security was designated when sending the job to the printer, the customer can enter a pin (code) number, and the UI can then indicate the location of their job and also unlock those bin(s).

Another optional user signaling feature is for the mailbox unit to have a conventional beeper or other audio signaling device to tell the operator or user to unload bins when (as soon as) his or her print a job is completed (fully stacked in the assigned mailbox bin or bins). This may be in addition to the visual display indicating which bins should be unloaded. This is particularly useful if the user is standing by the mailbox unit while that user's print job is running as in a "print on demand" mode, since the locked bin doors will preferably remain locked until the last sheet is in the last assigned bin.

The system can also automatically generate a network message back to the job senders terminal, if desired, as soon as a print job is completed and in a bin, so that the users screen displays a status message like "your job is in bin #3"; or "the printer is out of paper"; or the like. Or, as noted below, voice-mail may be used for this.

Presently available voice-mail systems, such as Xerox "V-Max", already have the capability of triggering pre-stored electronic messages to multiple voice-mail recipients in response to dialed in code numbers (or time events) to telephone addresses, which may also be pre-stored in the central voice-mail computer. In the present system, the controller 100 can auto-dial such voice mail trigger signals for sending a pre-stored mailbox job receipt voice mail message of the mailbox unit location and/or bin location.

Although a central LCD, CRT or other shared common display 104 is preferred, and reduces wiring and hardware, the system may, if desired, further optionally include the lighting of indicator lamps on or adjacent the user's bin, to direct the user to the proper bin to be unloaded. [Note, in this regard, the sorter bin indicator light art cited above.]

If a higher level "print on demand" security is chosen by a user, those jobs may be electronically stored in the printer or print server buffer memory but not yet printed. That customer would enter their his or her security number, and their jobs would then automatically be placed next in the printer print que (number one in priority), so as to start printing and sending those jobs to a mailbox. The mailbox UI could then also display the estimated time of arrival (ETA) of their job in the bin, as well as the bin number(s) where the job will be placed.

As noted, once customers remove their jobs from their bins, a bin empty sensor indicates to the system controller that those emptied bins are available for new job use and/or user re-assignments. Specifically, an in-bin sensor system determines "mailbox" availability.

A unique bin empty sensor system 110 is shown here, in FIGS. 14–16 in particular. Here, a single small infrared or other optical sensor unit 112 is mounted in each tray bottom 13 in a single aperture 13*a*. Each single unit 112 has its light beam transmitter 112*a* on one side and its light sensor (receiver) 112*b* on the other side. This is so that the light beam from one unit 112 in one bin floor 13 shines up [or down] to the light receiver 112*b* in the next unit 112 in the bottom of the next bin, and so on. If that bin 11 has any sheets in it, the sheets block the light beam, and the non-receipt of the light by receiving unit 112 so signals. Thus, only one single small integral sensor package 112 and connecting leads is required in each bin or tray 11, with a single wire harness and connector, rather than two units or housings and two wiring sets per bin. Thus, the "bin empty" sensor system 110 disclosed herein can reduce hardware and wiring. To express it another way, a single sensor unit 112 in the bin floor 13 transmits one light beam 14 from a light transmitter 112*a* to the light receiving sensor 112*b* in the next adjacent bin in one direction, while that same sensor unit 112 also normally receives another light beam from the opposite direction from the sensor unit 112 in the oppositely adjacent bin, unless that other light beam was interrupted by sheets in the oppositely adjacent bin. That is, here each emitter/detector unit 112 works in cooperation with the adjacent said units 112 in the bins above and below, not with itself, as in typical optical sensor units. Merely as examples of an optical emitter and detector which can be used are an Optek No. OP298 and an Optek No. OP555, mounted as shown in FIG. 14 in a plastic block with smoothly sloped ends or sides in the paper feeding direction so as not to catch sheet ends. As shown, the top of each unit 112 is preferable level with or below the sheet stacking surface of the bin tray bottom 13, so as to not interfere with sheet movement into or out of the bins.

As shown in FIG. 14, to compensate for the angles of the bins, yet allow perpendicular emitter beams and mountings in the bin trays, these sensor units 112 may each be offset from one another along the bin trays by a distance S which is equal to D sin(a), where "D" is the vertical distance between bin trays and "a" is their angle from the horizontal. Or, they may be mounted sideways, as in FIG. 16.

As noted, this bin empty sensor system 110 can additionally provide dual-mode functionality, by also sensing a drawer or bin opening, as well as unremoved sheet jobs, in individual bins, using the same sensor unit 112. That is, the same light beam blocked by sheets in the bin can also be blocked by the opening of the door to that same bin. [This is discussed further herein in connection with the disclosed bin privacy door systems.]

An important aspect of the novel "dynamic" (variable) user bin assignment system herein is that each "mailbox" or separate bin to be utilized therefor is frequently checked (updated) for reassignment of that bin to a new user. That is, reassignment to other users of bins which have since become available by the removal of all the printer output sheets therefrom by the previous user of those bins. Unlike a sorter or collator, it is not necessary to free up (empty) a whole series of bins. This is a dynamic mailbox system in which any one free bin can be fed job sheets, even if that one empty bin is between other, unemptied, bins. With this system, users do not have consistent bin assignments. Bins are assigned on a "first-come-first-served" basis, with the printers print job information. [The bins assigned are then stored in memory, to be identified whenever jobs are retrieved.]

This is enabled by the above described or other job-sheet-switchable "bin empty" sensors for each mailbox bin, which are electrically connected to the mailbox controller 100. See especially FIGS. 14–16, and also FIG. 12. The mailbox controller periodically interrogates these bin-empty sensors 112 to see which bins 11 are now empty. This interrogation is preferably done each time the printer and/or print server is sent (and/or is preparing to print) a print job. See, e.g., the flowcharts of FIG. 16, FIGS. 6–8, FIGS. 19–21 and also the electronic data information exchange illustrated in FIG. 5.

Various other "bin empty" sensors are taught in the cited and other art. However, it should be noted that many of them optically look through a set of several, or all, of the bins, not individual bins, or have other undesirable features such as switch arms that can become bent by paper jam removals. Typical emitter/reflector sheet sensor systems are undesirably error prone with curled or bent paper in the bins changing the distance therefrom, or paper lint or torn paper scrap blockage. In contrast, here the sensor emitter beam passes vertically up through the entire bin space, for transmissive, not reflective, detection, before it is detected, and the detector is not in a position to be blocked or contaminated.

As noted, a visual interactive indicator for guiding user bin unloading may desirably be provided by automatically opening the privacy doors 52 of the users bins needing unloading when the user enters his or her access or unlocking code. Automatically unlocking and at least partially opening the locked bin doors is preferred, since the opened doors clearly help show or guide the user to the correct bin or bins. Also, the operator can remove the job sheets from inside the bin with one hand, rather them having to use another hand to hold the bin privacy door open. This automatic bin door opening can be accomplished as shown in FIG. 13, for example, by a spring-loaded bin door which pops open by spring force when a simple solenoid escapement latch or the like is released by the solenoid receiving an electrical unlocking signal from the mailbox controller. Or, instead of pivotally opening bin doors, the bins themselves may open by sliding out like individual drawers. As shown in FIG. 16, after a user drawer has been released by a solenoid latch, it may pop open a short distance by spring force, and then be operator opened manually the rest of the way for job removal. Then, when it is pushed closed, it relatches like a conventional door.

As shown in the flowchart herein, the mailbox unit described herein is desirably preset in its controller software to use the above-described dynamic bin assignment for all bins as the automatic default. However, customers can optionally partially override that by a simple software key entry option which pre-assigns one or more bins to a specific user, so that other users cannot use that bin [no other users' print jobs are sent to that bin] until that special override is deleted, or a reassignment of that bin to another user is entered in the controller. [Or, a user may similarly chose to have all of their print jobs sent to an open bin or common stacker rather than a separate locked or unlocked mailbox until further notice, e.g., if they will be away for a while, or elect to send all their all print jobs to someone elses mailboxes, such as a secretary.] However, all remaining mailbox bins not so specially preassigned preferably remain free to be dynamically variably assigned.

The disclosed dynamic mailbox assignment system enables many more users to be able to share a printer than there are mailboxes, yet still have their jobs put into separate mailboxes, by automatically reassigning mailboxes, whenever they are free, to current printer users. As also taught here, the number of available mailboxes, and/or the ratio of locked to unlocked mailboxes and/or stacking trays, may be readily field retrofitably expanded or changed, if desired. The stapler may also be a field retrofittable optional accessory.

Another user programmable option can be to select whether or not to have the printer generate the usual "banner" (cover) sheets for each print job for that user. These job banner sheets may remain desirable, for example, for common stacking of unstapled intermixed jobs, but not necessarily for jobs already segregated by users into separate mailboxes, especially if the jobs are being stapled, as provided in the above-described mailbox unit. Eliminating banner sheets saves paper and improves productivity. This banner sheet versus no banner sheet selection is also desirably an automatic system default selection which may be overridden. Likewise, a manual or automatic system default selection of an open common or general use tray in the initial paper path may be made when the user job selection information or printer controller signals that the job is being printed on paper wanting special handling, or more likely to jam in the mailbox bin selection paper path or compiler system, such as carbonless paper, transparencies or envelopes.

It will be appreciated that many additional user option selections, and instructions for such selections, and other user instructional information, may be provided and automatically displayed. For example, users may be instructed to remove all sheets in a mailbox bin, and/or to not manually insert covers or other insert sheets into a bin unless a "stop print", pause, bin reassignment, or insert mode instruction is entered, to avoid a jam if further sheets are to be fed into that bin.

The control algorithm preferably always selects and fills first those available mailbox bins that are closest to the top of the mailbox bin array, since these higher bins are normally the easiest to unload. This is another advantage of this dynamic bin assignment system; all users can normally have an even chance to have an "upper" bin most of the time, except when there is heavy usage and many unremoved print jobs. However, a wheel chair bound or other disadvantaged user may want to have the algorithm programmed for him or her to always be assigned the lowermost available bin(s).

Another optional feature, for job removal assistance, is disclosed here in FIGS. 10–13. Unlocking and opening any bin privacy door 52 here also automatically, with a simple, low cost mechanism 120, lifts the exposed front edge of the output sets therein for easy operator removal. After the door 52 initially opens by a preset amount or angle, an integral conventional limited angle or stop hinge (FIGS. 10 and 13) or connecting link (FIGS. 12) also then begins to pivot up, with further door opening, an arm plate or flap 122 (which lifts up by a lesser total angle), from the tray bottom under that edge of the job set or sets in that bin. That allows the user to easily slide his or her hand under the job set to grasp and remove it from the bin as the bin door is fully opened.

As particularly shown in FIG. 10, this set lifter mechanism 120 also may serve to protectively cover, with lifter plate 122, when it is down, the usual bin or tray bottom 13 "cut outs" **13*b* for set removal assistance, which openings are not appropriate to have open in such a security or lockbox mailbox bin. [Also, bin hand insertion access to the bottom of the stacked sheets via such a cut-out 13*b* would be blocked by a closed bin privacy door on the next adjacent underlying privacy door anyway.] The set lifter 120 flap 122 enables the same bin trays (with cut-outs 13*b***) to be used for either secured (privacy door) and unsecured (open) bins, which is desirable for a "universal" or modular output device, especially to provide mixed functions and/or interchangeable output mailboxes.

As noted, two slightly different said stack lifting mechanisms are respectively shown in FIGS. 10, 11 and 13, versus FIG. 12. In either case, the arm or flap 122 lifts up the front edge of the stack when that bin door is opened. As shown, little additional hardware is required. Sets are easily removed in this manner even from low vertical height (small) bins, even though the operator cannot reach under the bin via cut-outs **13*b*** where the underlying bin has a locked bin door. This set lifter system is particularly effective where the lateral or edge jogger of the compiler aligns the job sets towards the front or bin door side of the bin, and/or where the printer and/or mailbox is an edge registered rather than center registered system.

After a suitable time delay for bin unloading after it is initiated, an audio beeper (and a visual instructional display on the LCD display 104 or the like) is also desirably provided to remind the user to reclose (and thus re-lock) the opened bin door(s), so that they can be reassigned to other users and reused. If the bins are not cleared and/or the bins doors are not so closed after a suitable time delay, another such audio/visual indication can desirably be provided for that.

Another desired system feature is that the controller 100 displays (and may also indicate to the system, e.g., the printer U.I.) from the mailbox memory, jobs printed more than 24 hours earlier and not yet removed from their bins. The systems administrator and/or key operator may be prompted by messages to remove those old jobs from mailboxes. He or she may be provided codes giving access to any or all bins for that, or other, purposes.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a mailbox module with sheet transport paths for separately collecting the print job sheets outputted by a shared user printer and selectably separating and feeding said print jobs of respective users into a superposed array of plural descrete mailbox print job sheet collection trays, the improvement wherein:

said mailbox module has left and right side printer job output sheet inputs, said mailbox module has at least one vertically modular replaceable sub-module, said mailbox module has both a right side generally vertical sheet transport input path, and a left side generally vertical sheet transport input path, for sequentially feeding sheets respectively from said left or right side sheet inputs vertically to said replaceable sub-module, said mailbox module has a third generally vertical sheet transport path from said replaceable sub-module past said array of plural mailbox print job sheet collection trays to provide a tray selection path; and said replaceable mailbox sub-module comprising at least one interchangeable sheet processing apparatus connecting between said mailbox sub-module sheet transport input paths and said third sheet transport path to form a part of said mailbox module sheet path;

said sheet processing apparatus operating on sheets in said mailbox sub-module prior to said separating and feeding of print job sheets into said mailbox print job sheet collection trays;

wherein a sheet stacking elevator and a selectable plurality of mailbox bins are removably mounted to said mailbox module to be selectably fed said printer output sheets by said third vertical sheet transport passing thereby.

2. The mailbox module for a shared user printer of claim 1, wherein said sub-module is vertically mounted on top of said mailbox module and additionally provides a generally horizontal fourth sheet path through said mailbox module for forwarding sheets therethrough on to another said mailbox module.

3. The mailbox module for a shared user printer of claim 1, wherein said sheet processing apparatus comprises a sheet rotator.

4. In a mailbox module with sheet transport paths for separately collecting the print job sheets outputted by a shared user printer and selectably separating and feeding said print jobs of respective users into a superposed array of plural descrete mailbox print job sheet collection trays, the improvement wherein:

said mailbox module has left and right side printer job output sheet inputs, said mailbox module has at least one vertically modular replaceable sub-module, said mailbox module has both a right side generally vertical sheet transport input path, and a left side generally vertical sheet transport input path, for sequentially feeding sheets respectively from said left or right side sheet inputs vertically to said replaceable sub-module, said mailbox module has a third generally vertical sheet transport path from said replaceable sub-module past said array of plural mailbox print job sheet collection trays to provide a tray selection path; and said replaceable mailbox sub-module comprising at least one interchangeable sheet processing apparatus connecting between said mailbox sub-module sheet transport input paths and said third sheet transport path to form a part of said mailbox module sheet path;

said sheet processing apparatus operating on sheets in said mailbox sub-module prior to said separating and feeding of print job sheets into said mailbox print job sheet collection trays;

wherein said sheet processing apparatus in said replaceable sub-module is consisting of at least one of a sheet rotator, a sheet inserter, a sheet inverter, a sheet folder, or a sheet hole punch.

5. The mailbox module for a shared user printer of claim 4, wherein said sub-module is vertically mounted on top of said mailbox module and additionally provides a generally horizontal fourth sheet path through said mailbox module for forwarding sheets therethrough on to another said mailbox module.

* * * * *